US006092982A

United States Patent [19]

Ikeda et al.

[11] Patent Number: 6,092,982

[45] Date of Patent: Jul. 25, 2000

[54] COOLING SYSTEM FOR A MAIN BODY USED IN A GAS STREAM

[75] Inventors: Kazutaka Ikeda; Akinori Koga; Junji Ishii, all of Kanagawa-ken, Japan

[73] Assignee: Kabushiki Kaisha Toshiba, Kawasaki, Japan

[21] Appl. No.: 08/862,301

[22] Filed: May 23, 1997

[30] Foreign Application Priority Data

May 28, 1996 [JP] Japan ..... 8-133484

[51] Int. Cl.[7] ..... F01D 5/18; F01D 9/06

[52] U.S. Cl. ..... 415/115; 415/914; 416/97 R; 137/806; 137/809; 137/811; 137/827; 165/109.1; 165/134.1; 165/908

[58] Field of Search ..... 415/115, 116, 415/176, 178, 914; 416/96 R, 96 A, 97 R, 97 A; 366/147; 137/806, 809, 811, 827, 896; 165/109.1, 134.1, DIG. 163, 908, 914

[56] References Cited

U.S. PATENT DOCUMENTS

| | | | |
|---|---|---|---|
| 3,624,751 | 11/1971 | Dettling | 137/807 |
| 4,456,428 | 6/1984 | Cuvillier | 416/97 R |
| 4,529,358 | 7/1985 | Papell . | |
| 4,653,983 | 3/1987 | Vehr . | |
| 4,738,588 | 4/1988 | Field . | |
| 4,923,371 | 5/1990 | Ben-Amoz | 416/97 R |
| 5,062,768 | 11/1991 | Marriage | 416/97 R |
| 5,096,379 | 3/1992 | Stroud et al. . | |
| 5,382,133 | 1/1995 | Moore et al. . | |
| 5,419,681 | 5/1995 | Lee . | |
| 5,498,133 | 3/1996 | Lee . | |
| 5,577,889 | 11/1996 | Terazaki et al. | 416/97 R |
| 5,688,107 | 11/1997 | Downs et al. | 416/97 R |

FOREIGN PATENT DOCUMENTS

| | | |
|---|---|---|
| 0 375 175 | 6/1990 | European Pat. Off. . |
| 0 501 813 | 9/1992 | European Pat. Off. . |
| 0 677 644 | 10/1995 | European Pat. Off. . |
| 1164847 | 9/1969 | United Kingdom . |

*Primary Examiner*—Christopher Verdier
*Attorney, Agent, or Firm*—Finnegan, Henderson, Farabow, Garrett & Dunner, L.L.P.

[57] ABSTRACT

Structure with elements includes a main body of the element used in gas stream and a plurality of fluid passage. Each outlet of the fluid passage is opened on surface of the main body. Coolant fluid flows from each outlet through the passage to cover the surface as a film-like fluid. The plurality of fluid passages include first fluid passages and second fluid passages. The coolant fluid flows from the outlet of the first fluid passage along the direction of the gas stream on the surface. On the other hand, the coolant fluid also flows from the outlet of the second fluid passage toward the gas stream neighbored on each outlet of the first fluid passage.

16 Claims, 37 Drawing Sheets

COOLING SYSTEM FOR A MAIN BODY USED IN A GAS STREAM

FIELD OF THE INVENTION

The present invention relates to a structure with elements including a main body used in a gas stream, and especially relates to the main body including a plurality of fluid passages used in the gas stream.

BACKGROUND OF THE INVENTION

In a gas turbine, if the gas temperature is high during a first stage of the turbine, the efficiency for generating electric power increases. However, in order to raise the gas temperature for the first stage of the turbine, the heat-durability of the turbine blade and turbine nozzle should also be increased. As a method for raising the heat-durability of the gas turbine, film cooling by fluid on the blade surface is well known. FIG. 1 is a schematic diagram of the turbine blade of the gas turbine according to the prior art. The turbine blade consists of a main body 1 of the blade and a base 2 to attach the main body to a rotor (not shown in FIG. 1). FIG. 2 is a sectional plan of line K—K of FIG. 1. FIG. 3 is a sectional plan of the J—J line of FIG. 1. As shown in FIG. 2 and FIG. 3, three coolant passages 3*a,* 3*b,* 3*c* are formed in the base 2 and the main body 1. The three coolant passages are connected to a supply source of cooling fluid. The cooling fluid in the coolant passage 3*a,* 3*b,* 3*c* executes convective cooling through the base 2 and the main body 1. When the cooling fluid flows through the coolant passages 3*a,* 3*b,* it flows out through a plurality of outlets 8 on the leading edge 4, side wall 5, other side wall 6, tip 7. The cooling fluid in the coolant passage 3*c* flows out through outlets 10 on the trailing edge 9.

The outlet of coolant passage is normally formed as an ellipse. FIG. 4 is a schematic diagram of the outlet of the coolant passage on the blade surface according to the prior art. FIG. 5 is a sectional plan of line L—L of FIG. 4. As shown in FIG. 4 and FIG. 5, in the outlet 8 passing through the side wall 5 and the other side wall 6, the center line 12 of the outlet of the coolant passage is inclined in the direction of the gas stream 11 on the surface of the wall 5 (6). The cooling fluid flowing from the outlet 8 is mixed with the gas stream 11 flowing over the surface at high speed, and cools the surface by forming a film-like layer over it. As a method for setting the outlet on the surface, plural lines of the outlets 8 perpendicular to the direction of the gas stream 11 may be set as shown in FIG. 6 and FIG. 7. In order to supplement the outlets 8 on the upstream side, the outlets 8 on the downstream side, whose position is different from the position of the outlets on the upstream side, are set as shown in FIG. 8. Furthermore, in order to strengthen the film cooling effectiveness of the spread of the fluid, the diameter of the outlet 13 is gradually increased as it reaches the surface as shown in FIG. 9A and FIG. 9B. Alternatively, as shown in FIG. 10, the outlet 13 is opened at fixed intervals as it reaches the surface, thus resembling a staircase.

However, in the film cooling method in which the center line 12 of the coolant passage is inclined in the direction of the stream, the following problem occurs.

The cooling fluid flowing from the outlet 8 has a high Kinetic energy stream that crosses the direction of the gas stream flowing along the surface. Therefore, as shown in FIG. 11, a separation of the coolant as the cooling fluid flows up in a columnar shape occurs. As a result, the gas stream 11 is divided by a pillar 14 of cooling fluid flown from the outlet 8 and rolled up in the downstream area of the pillar 14. This makes it is difficult for the fluid film to cover the surface 5 (6) and therefore film cooling effectiveness reduces. Furthermore, when the outlet is shaped as shown in FIG. 9B and FIG. 10, the fluid film covers only 70% of the surface interval between neighboring outlets. In addition, the pressure of the fluid flowing from the outlet is low because of the wide outlet 13. Therefore, in the downstream area of the outlet 8 on the surface 5 (6), the gas stream 11 mixes with the cooling fluid 14, and the film cooling effectiveness is low.

On the other hand, according to the prior method shown in FIGS. 12A and 12B, the direction of the coolant passage is inclined in a direction different from the direction of the gas stream along the surface (i.e., the "lateral direction"). In this method, the fluid diffuses laterally in the direction of the gas stream. In short, the flown fluid diffuses only along the lateral area in the direction of the gas stream. The film cooling effectiveness of the fluid for downstream area is therefore low.

As another prior method shown in FIGS. 13A and 13B, the outlet is shaped as a diffusion type in addition to the specific feature of FIGS. 12A and 12B. In this method, the center line of the diffusion part is inclined in the lateral direction similar to the center line of the outlet of the coolant passage. Therefore, the film cooling effectiveness of the fluid over the downstream area is low in the same way as shoewn in FIGS. 12A and 12B.

SUMMARY OF THE INVENTION

It is an object of the present invention to provide a structure with elements that are able to suppress the roll up of the gas stream for the fluid downstream of each outlet on surface of the main body.

It is another object of the present invention to provide a structure with elements, which are able to uniformly spread the cooling fluid over wide area of the surface as a fluid film.

According to the present invention, there is provided a structure with elements including a main body of the elements used in the gas stream and a plurality of fluid passages. Each outlet opens onto the surface of the main body and fluid flows from each outlet through the passage to cover the surface as a fluid film, wherein the plurality of fluid passages, comprising: a first fluid passage, from which fluid flows in the direction of the gas stream on the surface, and a second fluid passage, adjoining the first fluid passage from which fluid flows against the gas stream to suppress the roll up of the gas stream caused by the fluid downstream of each outlet.

Further in accordance with the present invention, there is provided a structure with elements, including a main body of the element used in the gas stream and a plurality of fluid passages. The fluid passages have outlets which open onto the surface of the main body, through which the fluid flows, covering the surface in the form of a film. The plurality of fluid passages, comprise: a first fluid passage, from which fluid flows along a predetermined direction different from the direction of the gas stream on the surface, and a second fluid passage adjoining the first fluid passages, from which fluid flows against the gas stream to suppress roll up of the gas stream caused by the fluid downstream of each outlet.

Further in accordance with the present invention, there is provided a structure with elements, including a main body of the element used in the gas stream and a plurality of fluid passages, each outlet of which opens onto the surface of the main body. Fluid flows from each outlet through the passage to cover the surface as a fluid film. The plurality of fluid passages are configured so that a center line of each fluid passage is inclined in the direction of the gas stream flowing on the surface.

Further in accordance with the present invention, there is provided structure with elements, including a main body of the element used in gas stream and a plurality of fluid passages, each outlet of which opens onto the surface of the main body. Fluid flows from each outlet through the passage to cover the surface as a fluid film. The plurality of fluid passages are configured so that a center line of each fluid passage is inclined in the direction of the gas stream on the surface. The fluid passages includes an inner wall forming the fluid passage toward the outlet on the surface of the main body. The inner wall is inclined toward the upstream side of the edge of the outlet from a predetermined inner position in the direction of the inner wall to the upstream side of the edge of the outlet on the surface.

Further in accordance with the present invention, there is provided a structure with elements, including a main body of the element used in the gas stream and a plurality of fluid passages, each outlet of which opens onto the surface of the main body. Fluid flows from the each outlet through the passage to cover the surface as a fluid film. The plurality of fluid passages comprising a diffusion outlet partially extended from each outlet on the surface. The diffusion outlet is shaped asymmetrically, based on the direction of the fluid stream from the each outlet. One edge of the diffusion outlet is perpendicular to the direction of the gas stream.

DETAILED DESCRIPTION OF THE PREFERRED EMBODIMENT

Figure 14A:
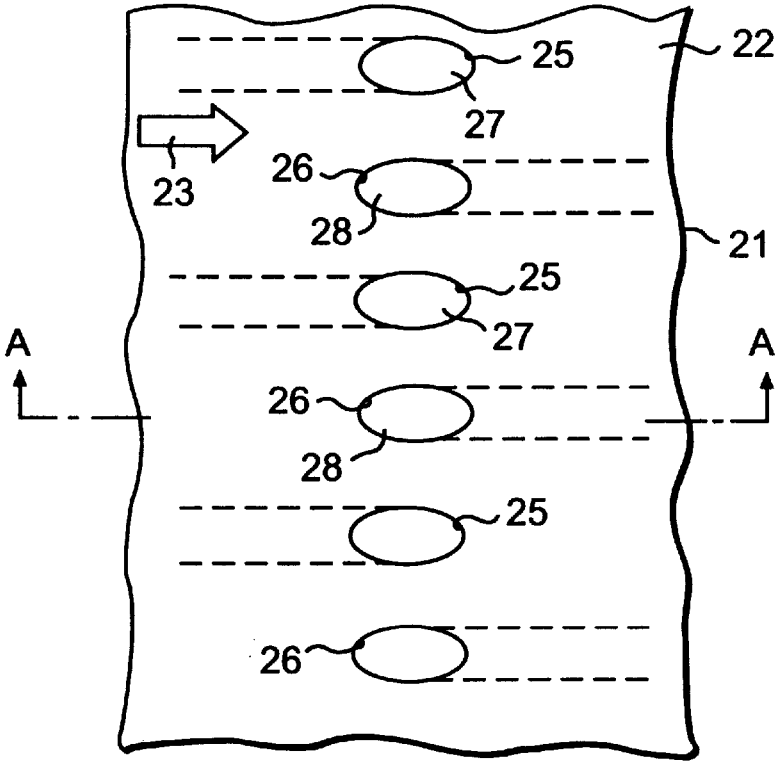
FIG. 14A is a schematic diagram of the outlet of the coolant passage on the surface of the blade according to a first embodiment of the present invention.
Figure 14B:
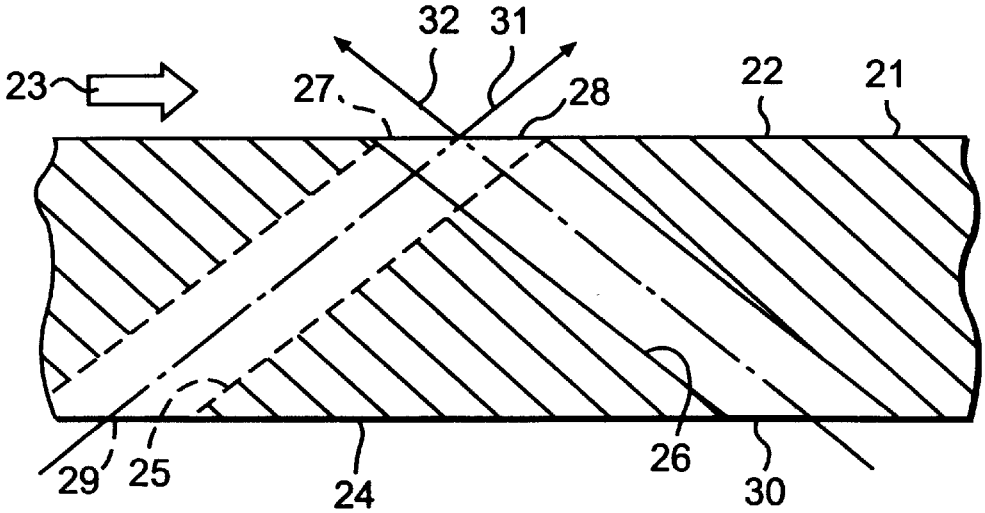
FIG. 14B is a sectional plan of line A—A of FIG. 14A.

FIG. 14A is a plan view of an outlet of a coolant passage on the surface of the turbine blade according to a first embodiment of the present invention. FIG. 14B is a sectional plan of line A—A of FIG. 14A. In FIGS. 14A and 14B, material 21 represents a main body such as the turbine blade or the turbine nozzle. The high temperature gas stream 23 flows over one surface 22 of the main body 21. In the main body 21, a plurality of main passages (first outlet 27 of coolant passage 29) 25 and a plurality of subpassages (second outlet 28 of coolant passage 30) 26 are set. Each section of the main passage 25 and the sub passage 26 is circularly shaped. The first outlet 27 and the second outlet 28 are mutually located along a direction perpendicular to the direction of the gas stream 23 on the surface 22. The cooling fluid flows from the first outlet 27 through the first coolant passage 29 and from the second outlet 28 through the second coolant passage 30. A center line 31 of the first coolant passage 29 is inclined to the downstream side in relation to the direction of the gas stream 23. A center line 32 of the second coolant passage 30 is inclined to the upstream side in relation to the direction of the gas stream 23. The first coolant passage 29 and the second coolant passage 30 are connected to a supply section of the cooling fluid (not shown). Preferably, the section size of the first outlet 27 is larger than the section size of the second outlet 28.

Preferably, an inclination angle of the first coolant passage 29 facing downstream is smaller than an inclination angle of the second coolant passage 30 facing upstream. Furthermore, the spaces between the first outlets 27, whose direction is perpendicular to the direction of the gas stream 23, are preferably less than three to five times the diameter of the circular of the passage 25. In the above-mentioned structure, the cooling fluid flows from the first outlet 27 to the downstream side in relation to the direction of the gas stream 23. The cooling fluid flows from the second outlet 28 to the upstream side on the surface 22. In this case, the cooling fluid flowing from the second outlet 28 collides with the gas stream 23 passing along side of the first outlet 27. Therefore, the gas stream 23 does not roll up the pillar of the cooling fluid flowing from the first outlet 27. In short, the pillar of cooling fluid easily settles on the downstream side and the cooling fluid film spreads widely along the downstream area. Furthermore, the cooling fluid from the second outlet 28 mixes with the gas stream 23 and the temperature of the gas stream drops. The low temperature gas stream flows on the space between the neighboring first outlets 27. Therefore, cooling for the space between neighboring first outlets 27 is executed and the surface temperature distribution in the direction perpendicular to the direction of the gas stream is made uniform.

Figure 15A:
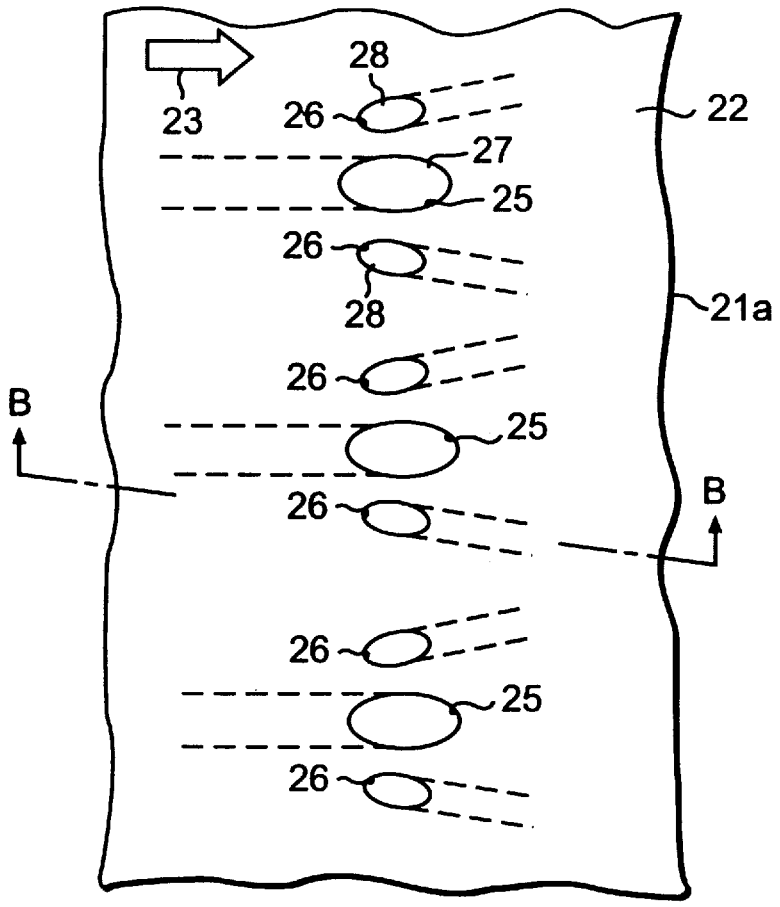
FIG. 15A is a schematic diagram of the outlet of the coolant passage on the surface of the blade according to a second embodiment of the present invention.
Figure 15B:
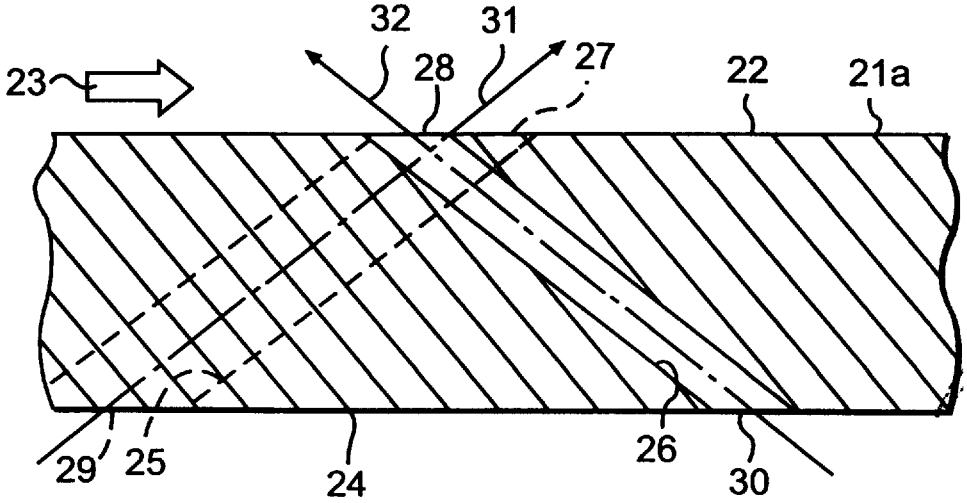
FIG. 15B is a sectional plan of line B—B of FIG. 15A.

FIG. 15A is a plan of an outlet of a coolant passage on the surface of the turbine according to a second embodiment of the present invention. FIG. 15B is a sectional plan of line B—B of FIG. 15A. In structure of the second embodiment in FIGS. 15A and 15B, two second outlets 28 are located on both sides of the first outlet 27. The two center lines of the two second outlets 28 mutually cross on the upstream side of the first outlet 27 based on the direction of the gas stream 23. The direction of this intersecting flow opposes the direction of the gas stream, which is rolled up. In the second embodiment, the efficiency of the cooling fluid from the second outlet increases. In short, the gas stream 23 roll-up of the cooling fluid flowing from the first outlet 27 is avoided. The cooling fluid film certainly spreads on the downstream side from the first outlet 27.

Figure 16A:
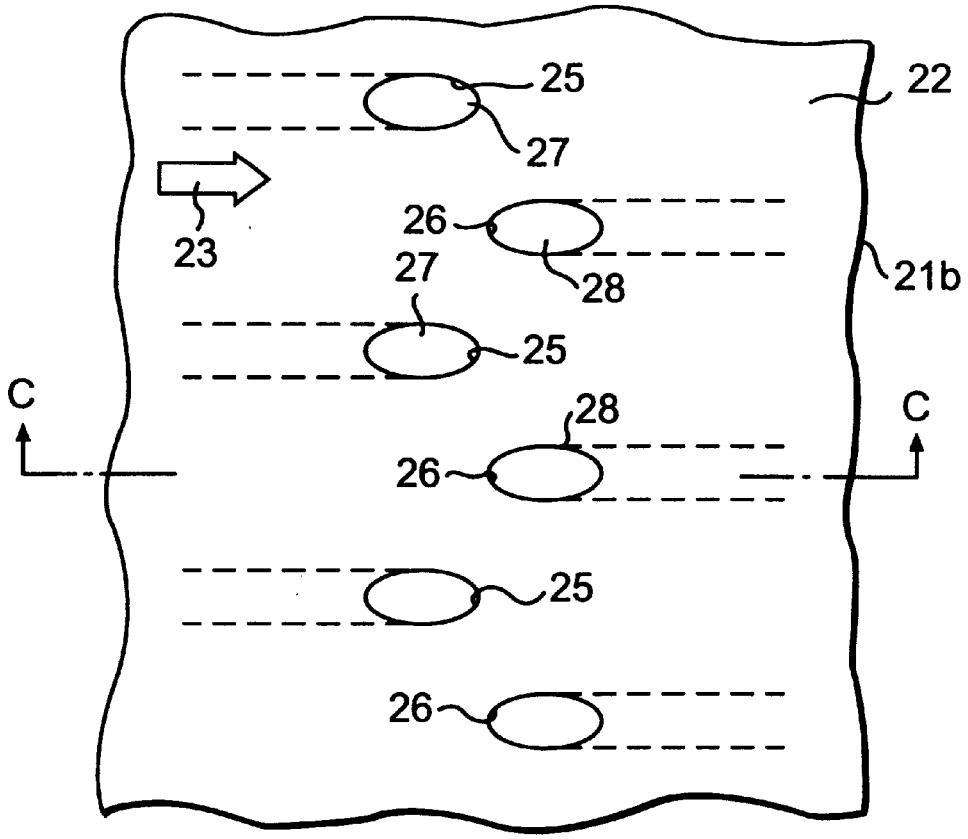
FIG. 16A is a schematic diagram of the outlet of the coolant passage on the surface of the blade according to a third embodiment of the present invention.
Figure 16B:
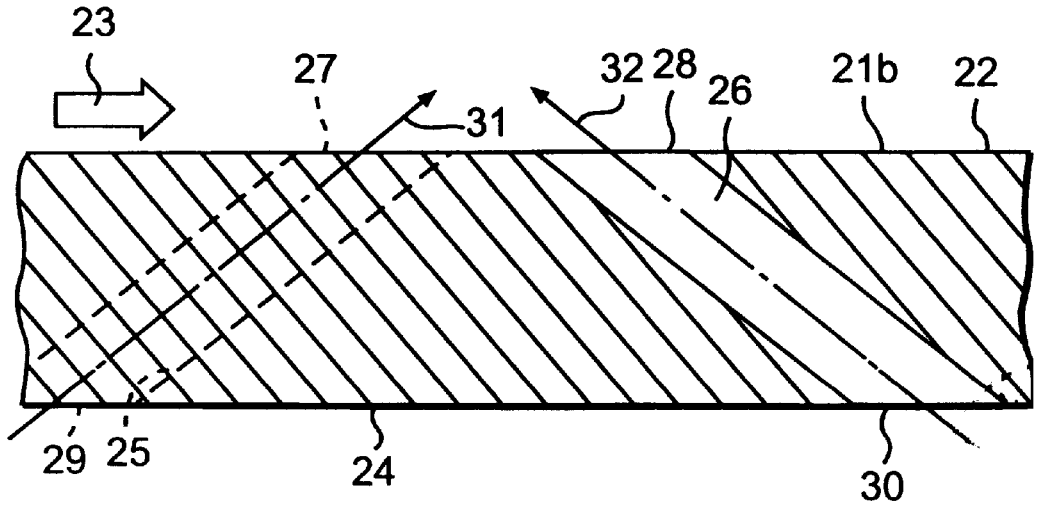
FIG. 16B is a sectional plan of line C—C of FIG. 16A.

FIG. 16A is a plan of an outlet of a coolant passage on the surface of the turbine blade according to a third embodiment of the present invention. FIG. 16B is a sectional plan of line C—C of FIG. 16A. In the structure of the third embodiment, the second outlets 28 are respectively arranged downstream from the arrangement line of the first outlets 27 in addition to the structure of the first embodiment. As in the first embodiment, the cooling fluid flowing from the second outlet 28 collides with the gas stream 23 passing along side of the first outlet 27. Therefore, the gas stream 23 roll-up of the pillar of the cooling fluid flowing from the first outlet 27 does not occure. The cooling fluid film thus widely spreads over the downstream area. Furthermore, the cooling fluid from the second outlet 28 mixes with the gas stream 23 and the temperature-of the gas stream drops. The low temperature gas stream flows over the space between neighboring first outlets 27. Cooling of the space between the neighboring first outlets 27 is thus executed.

Figure 17A:
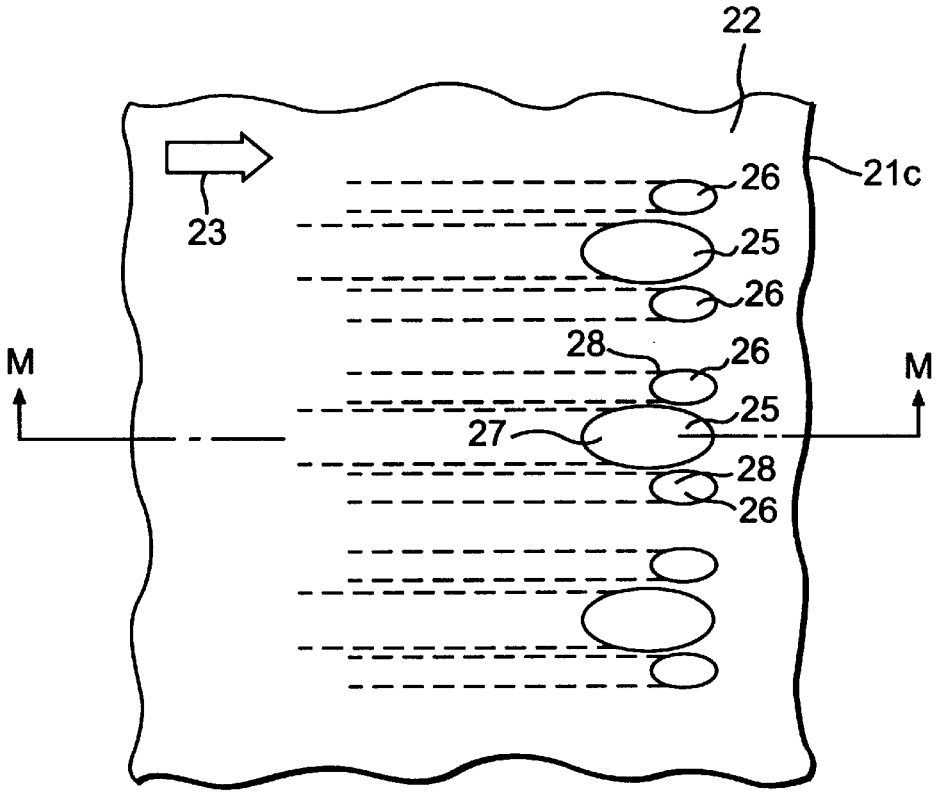
FIG. 17A is a schematic diagram of the outlet of the coolant passage on the surface of the blade according to a fourth embodiment of the present invention.
Figure 17B:
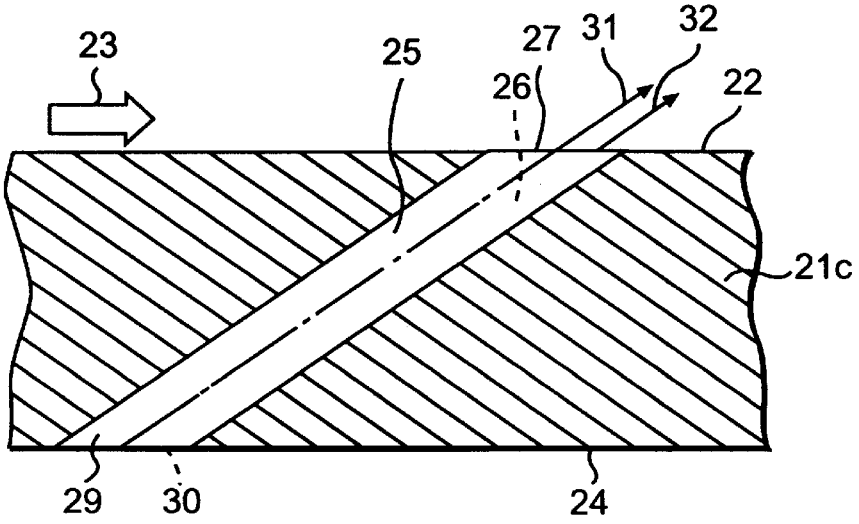
FIG. 17B is a sectional plan of line M—M of FIG. 17A.

FIG. 17A is a plan of an outlet of a coolant passage on the surface of the turbine blade according to a fourth embodiment of the present invention. FIG. 17B is a sectional plan of line M—M of FIG. 17A. In the structure of the fourth embodiment, two second outlets 28 (26) are located on both sides of the first outlet 27 (25). Two center lines 32 of the two second outlets 28 are parallel to the center line 31 of the first outlet 27. The cooling fluid flowing from the second outlets 28 obstructs the gas stream 23 passing on both sides of the first outlet 27. As a result, the gas stream 23 roll-up the fluid flowing from the first outlet 27 is avoided. Accordingly, the pillar of the cooling fluid easily settles on the downstream area and the cooling fluid film spreads widely and uniformly on the downstream area.

In the four above-mentioned embodiments, the center line 31 of the first coolant passage 25 is inclined to the downstream side relative to the direction of the gas stream 23, and the center line 32 of the second coolant passage is inclined to the upstream side or the downstream side. However, the center line 31 of the first coolant passage 25 may be inclined to the upstream side and the center line 32 of the second coolant passage may be inclined to the downstream side or the upstream side. In this case, the cooling fluid flowing from the first outlet collides with the gas stream and the cooling fluid flowing from the second outlet obstructs passage of the gas stream. Therefore, the gas stream roll-up of the cooling fluid is avoided. Furthermore, the temperature of the gas stream drops and this gas stream flows downstream from the first outlet. The fluid film therefore settles uniformly on the downstream side.

Figure 18A:
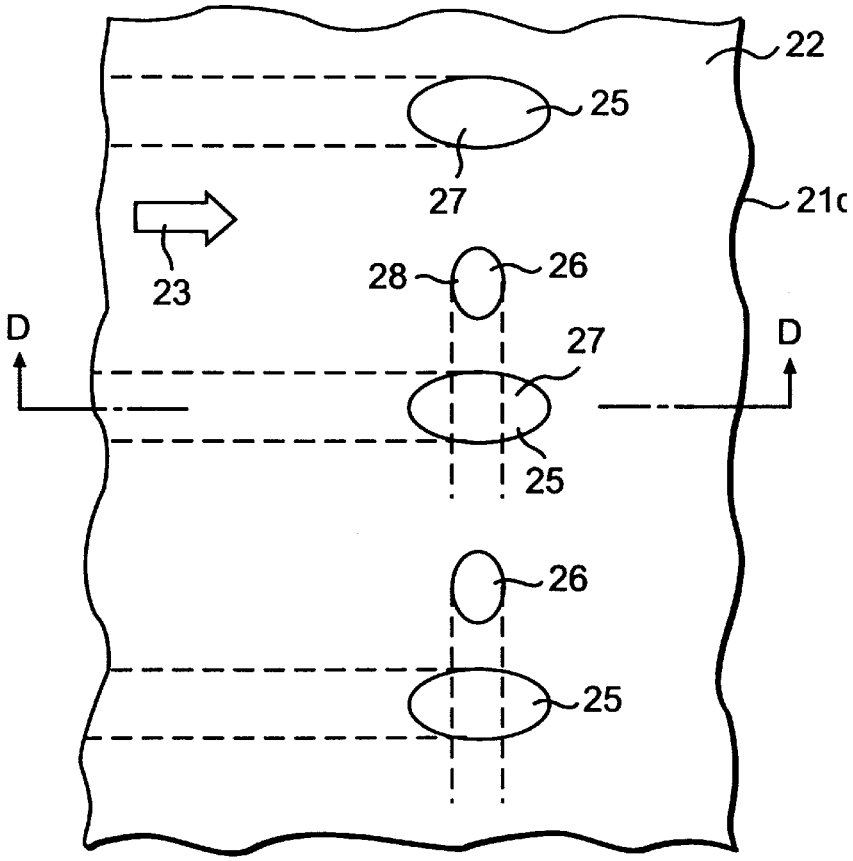
FIG. 18A is a schematic diagram of outlet of coolant passage on surface of the blade according to a fifth embodiment of the present invention.
Figure 18B:
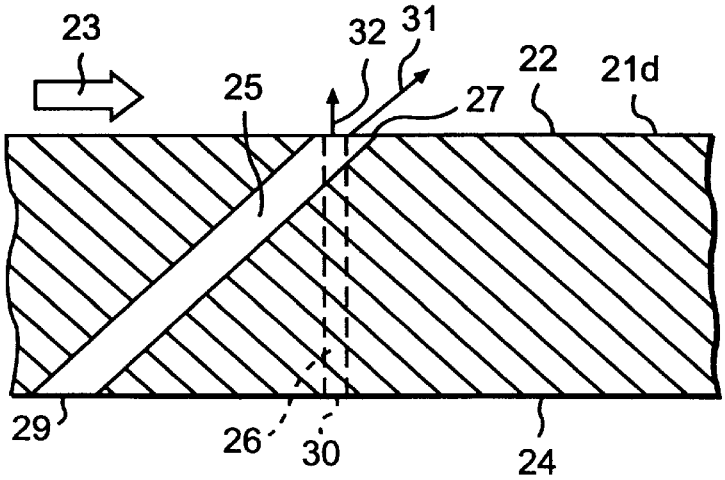
FIG. 18B is a sectional plan of line D—D of FIG. 18A.

FIG. 18A is a plan of an outlet of a coolant passage on the surface of the turbine blade according to a fifth embodiment of the present invention. FIG. 18B is a sectional plan of line D—D of FIG. 18A. In the fifth embodiment, the second outlet 28 is located between the neighboring two first outlets 27 and a center line 32 of the second coolant passage 26 is inclined along a direction perpendicular to the direction of the gas stream 23. The cooling fluid flowing from the outlet 28 obstructs the gas stream 23 passing on both sides of the first outlets 27. As a result, the gas stream 23 roll-up of the cooling fluid flowing from the first outlet 27 is avoided. Accordingly, the pillar of the cooling fluid easily settles on the downstream side and the cooling fluid film spreads widely on the downstream area.

Figure 19A:
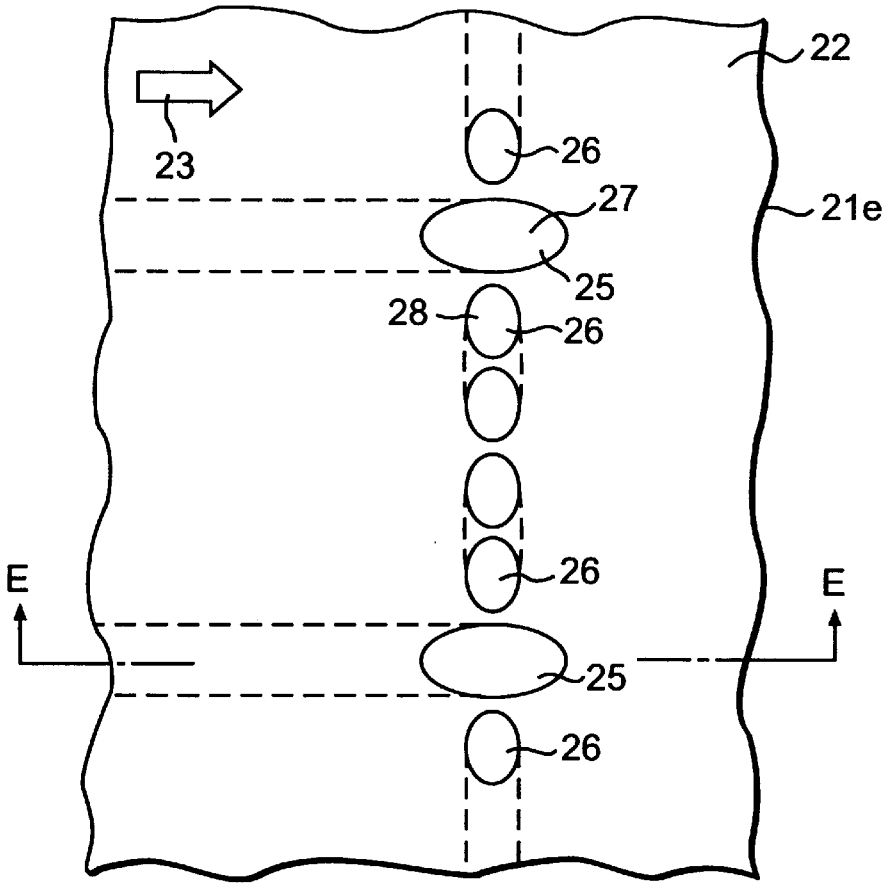
FIG. 19A is a schematic diagram of the outlet of the coolant passage on the surface of the blade according to a sixth embodiment of the present invention.
Figure 19B:
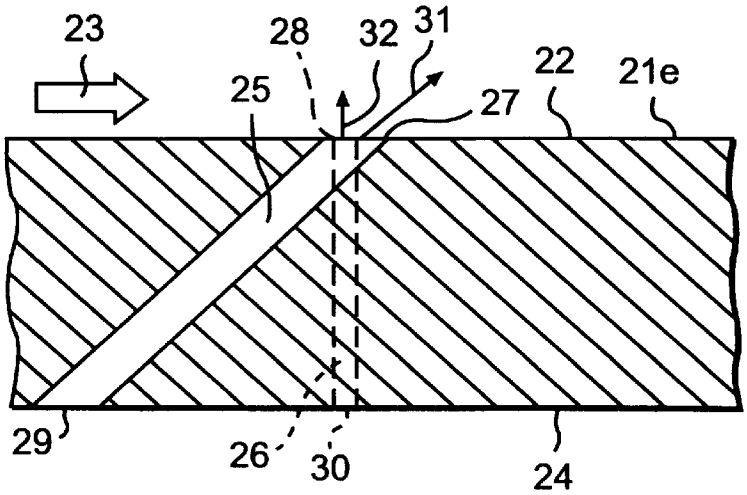
FIG. 19B is a sectional plan of line E—E of FIG. 19A.

FIG. 19A is a plan of the outlet of the coolant passage on the surface of the turbine blade according to a sixth embodiment of the present invention. FIG. 19B is a sectional plan of line E—E of FIG. 19A. In the sixth embodiment, two second outlets 28 (26) are located on both sides of the first outlet 27 (25). The two center lines of the two second coolant passages 26 intersects at a position above the first outlet 27. The upper position departs from the first outlet 27 after a predetermined distance. Therefore, cooling fluid flowing from the outlet 28 obstructs the gas stream 23 passing on both side of the first outlet 27. As a result, the gas stream 23 roll-up of the cooling fluid flowing from the first outlet 27 is avoided. Accordingly, the pillar of the cooling fluid easily settles on the downstream side and the cooling fluid film spreads widely on the downstream area.

Figure 20A:
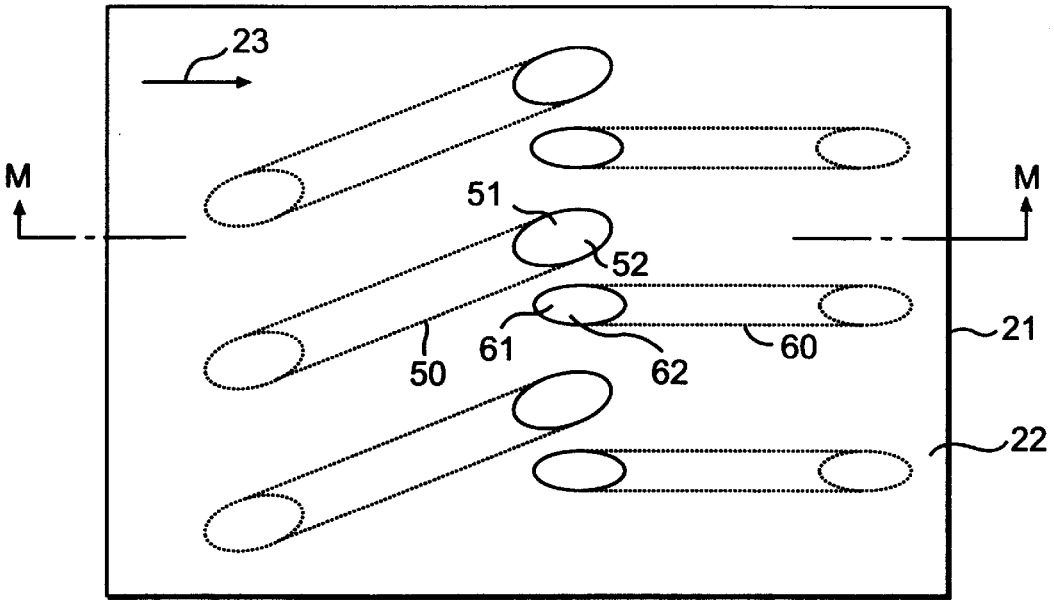
FIG. 20A is a schematic diagram of the outlet of the coolant passage on the surface of the blade according to a seventh embodiment of the present invention.
Figure 20B:
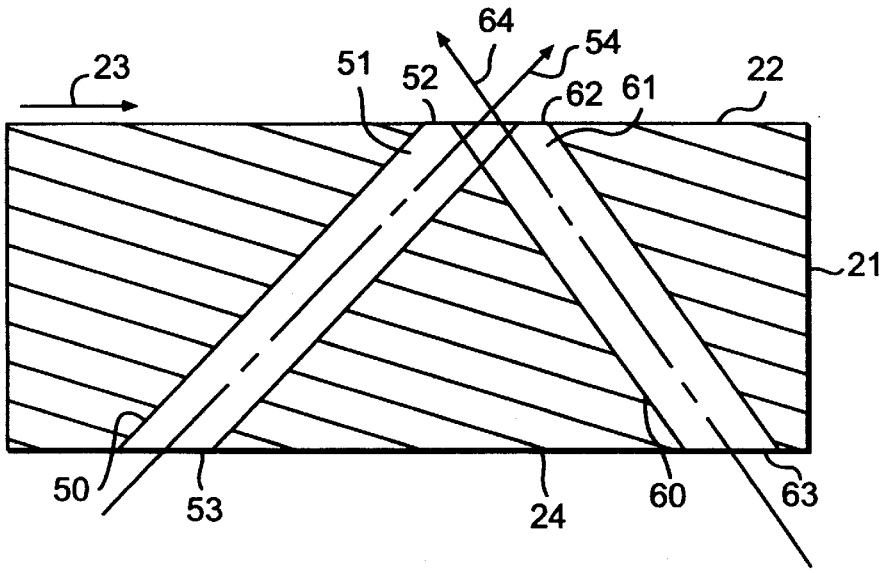
FIG. 20B is a sectional plan of line M—M of FIG. 20A.

FIG. 20A is a plan of a coolant passage on the surface of the turbine blade according to a seventh embodiment of the present invention. FIG. 20B is a sectional plan of line M—M of FIG. 20A. In the seventh embodiment, the first coolant passage 50 is inclined in the lateral direction of the downstream side of the gas stream 23. The second coolant passage 60 is inclined to the upstream side on the surface 22. In the structure of the seventh embodiment, the cooling fluid flows from the first outlet 52 toward the lateral direction of the downstream side. On the other hand, the cooling fluid flows from the second outlet 62 toward the upstream side. In this case, the cooling fluid flowing from the second outlet 62 suppresses the roll-up of the gas stream 23 of the cooling fluid flowing from the first outlet 52. In addition, the cooling fluid flowing from the second outlet 62 mixes with the gas stream 23. Therefore, the cooling fluid film uniformly spreads in the lateral direction on the surface 22. Furthermore, the cooling fluid flows from the first outlet 52 in the lateral direction of the downstream side. Therefore, the cooling fluid film widely spreads toward the lateral direction of the downstream side.

Figure 21A:
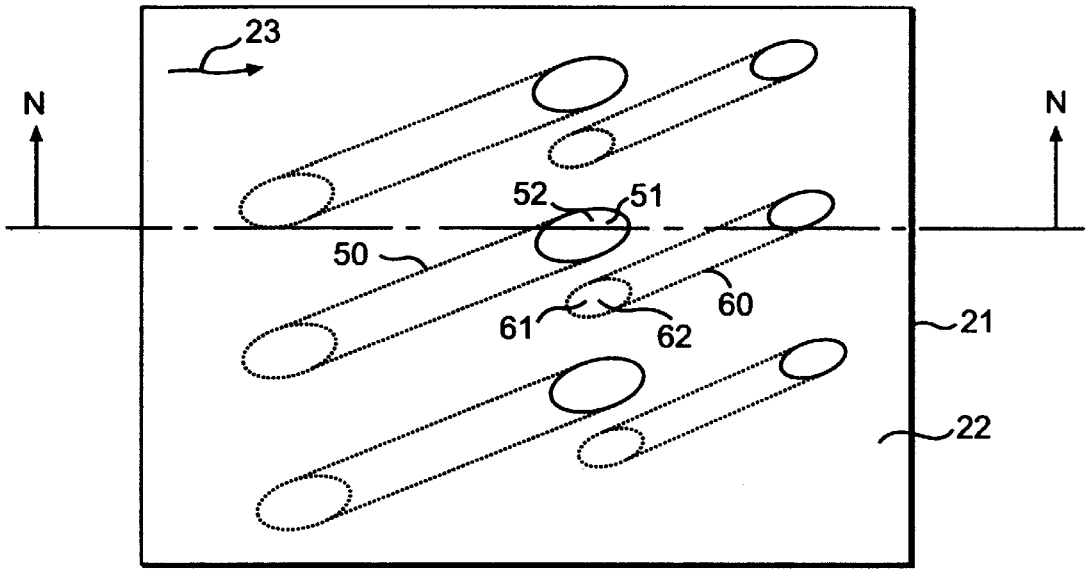
FIG. 21A is a schematic diagram of the outlet of the coolant passage on the surface of the blade according to an eighth embodiment of the present invention.
Figure 21B:
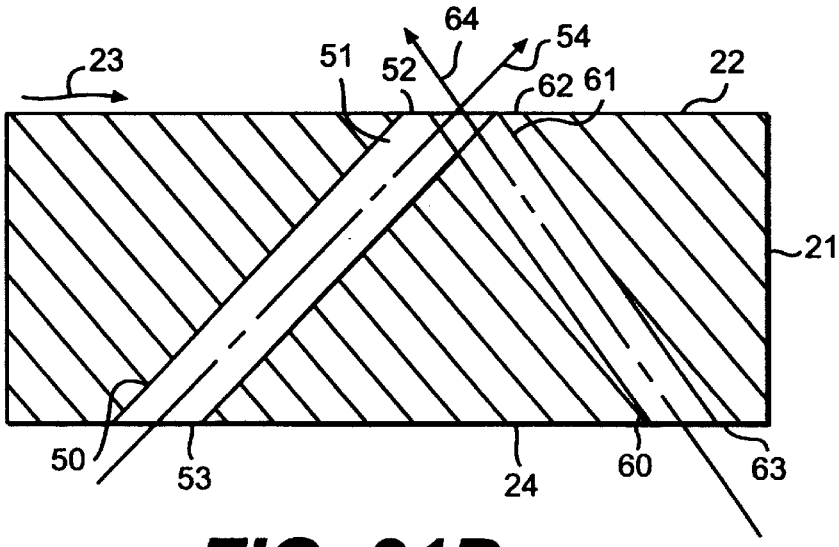
FIG. 21B is a sectional plan of line N—N of FIG. 21A.

FIG. 21A is a plan of a coolant passage on the surface of the turbine blade according to an eighth embodiment of the present invention. FIG. 21B is a sectional plan of line N—N of FIG. 21A. In the eighth embodiment, the first coolant passage 50 is inclined to the lateral direction of the downstream side of the gas stream 23. The second coolant passage 60 is inclined to the lateral direction of the upstream side. The direction of the center line 54 of the first coolant passage 50 is parallel to the direction of the center line 64 of the second coolant passage 60 on the surface 22. In the structure of the eighth embodiment, the cooling fluid flows from the first outlet 52 toward the lateral direction of the downstream side. On the other hand, the cooling fluid flows from the second outlet 62 toward the lateral direction of the upstream side. In this case, the cooling fluid flowing from the second outlet 62 suppresses the roll-up of the gas stream 23 of the cooling fluid flowing from the first outlet 52. In addition, the cooling fluid flowing from the second outlet 62 mixes with the gas stream 23. Therefore, the cooling fluid film is uniformly spread in the lateral direction on the surface 22. Furthermore, the cooling fluid flown from the first outlet 52 flows from the first outlet 52 toward the lateral direction of the downstream side. Therefore, the cooling fluid film widely spreads in the lateral direction of the downstream side.

Figure 22A:
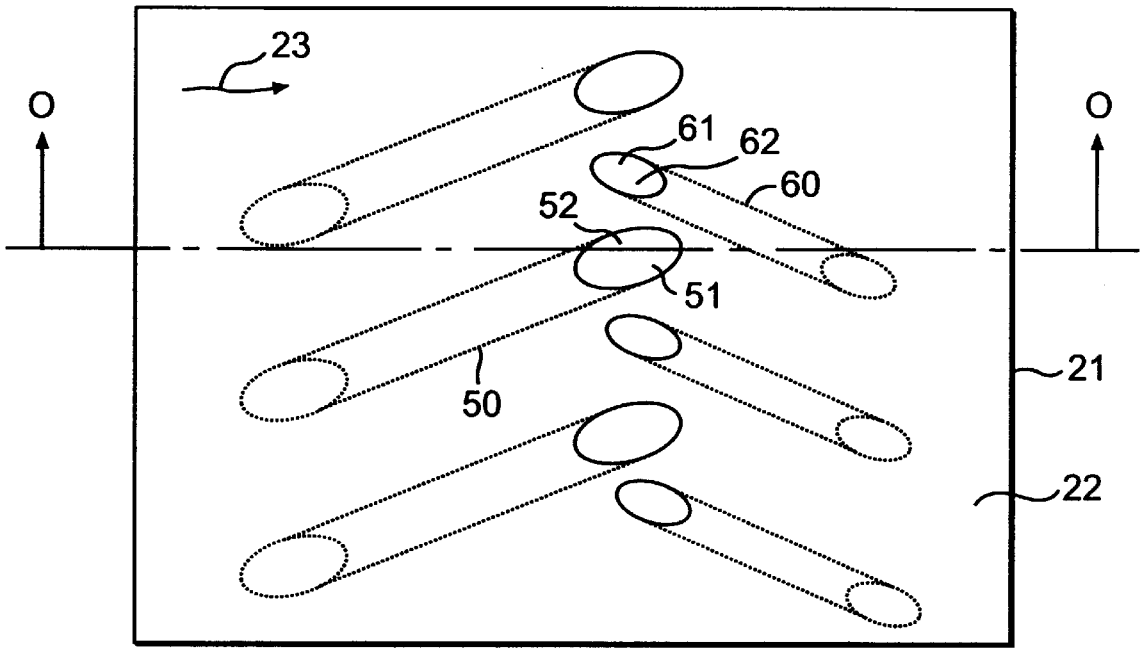
FIG. 22A is a schematic diagram of the outlet of the coolant passage on the surface of the blade according to a ninth embodiment of the present invention.
Figure 22B:
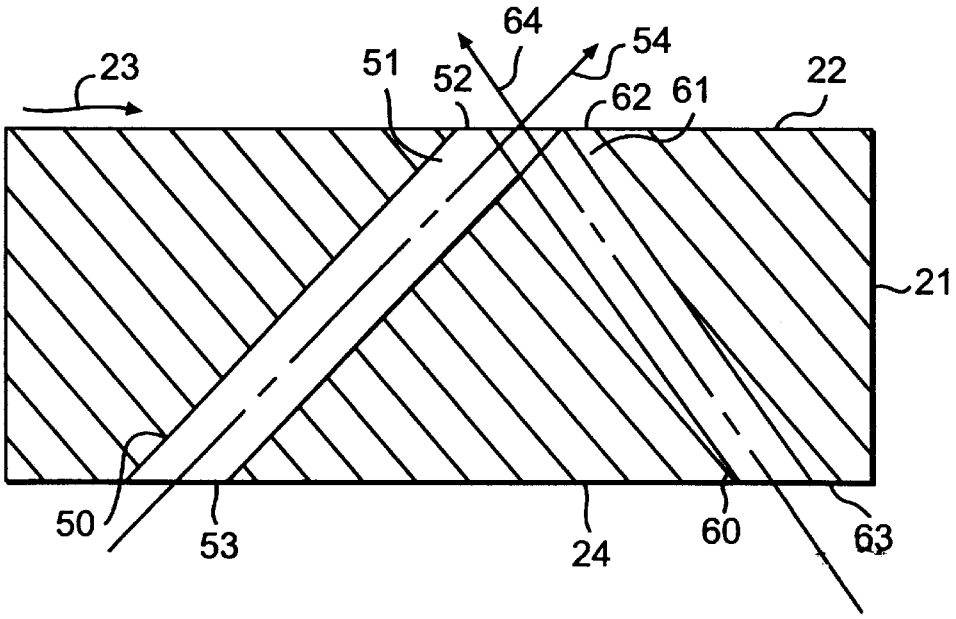
FIG. 22B is a sectional plan of line O—O of FIG. 22A.

FIG. 22A is a plan of a coolant passage on the surface of the turbine brade according to ninth embodiment of the present invention. FIG. 22B is a sectional plan of line O—O of FIG. 22A. In the ninth embodiment, the first coolant passage 50 is inclined in the lateral direction of the downstream side of the gas stream 23. The second coolant passage 60 is inclined in the lateral direction of the upstream side. Furthermore, the center line 54 of the first coolant passage 50 intersects the center line 64 of the second coolant passage 60 at more than 90 degrees. In the structure of the ninth embodiment, the cooling fluid flows from the first outlet 52 in the lateral direction of the downstream side. On the other hand, the cooling fluid flows from the second outlet 62 in the lateral direction of the upstream side. In this case, the cooling fluid flowing from the second outlet 62 suppresses the roll-up of the gas stream 23 of the cooling fluid flowing from the first outlet 52. In addition, the cooling fluid flowing from the second outlet 62 mixes with the gas stream 23. Therefore, the cooling fluid film spreads uniformly in the lateral direction on the surface 22. Furthermore, the cooling fluid flows from the first outlet 52 in the lateral direction of the downstream side. Therefore, the cooling fluid film widely spreads in the lateral direction of the downstream side.

Figure 23A:
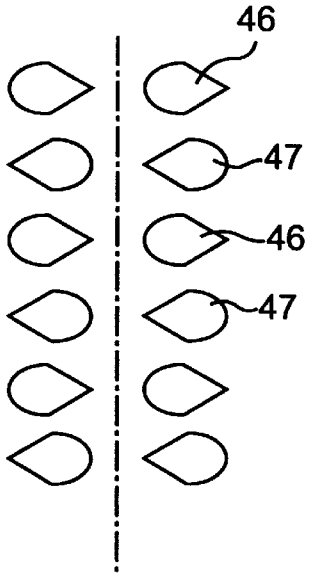
FIGS. 23A and 23B are schematic diagrams of the turbine blade including the coolant passages according to the first embodiment.
Figure 23B:
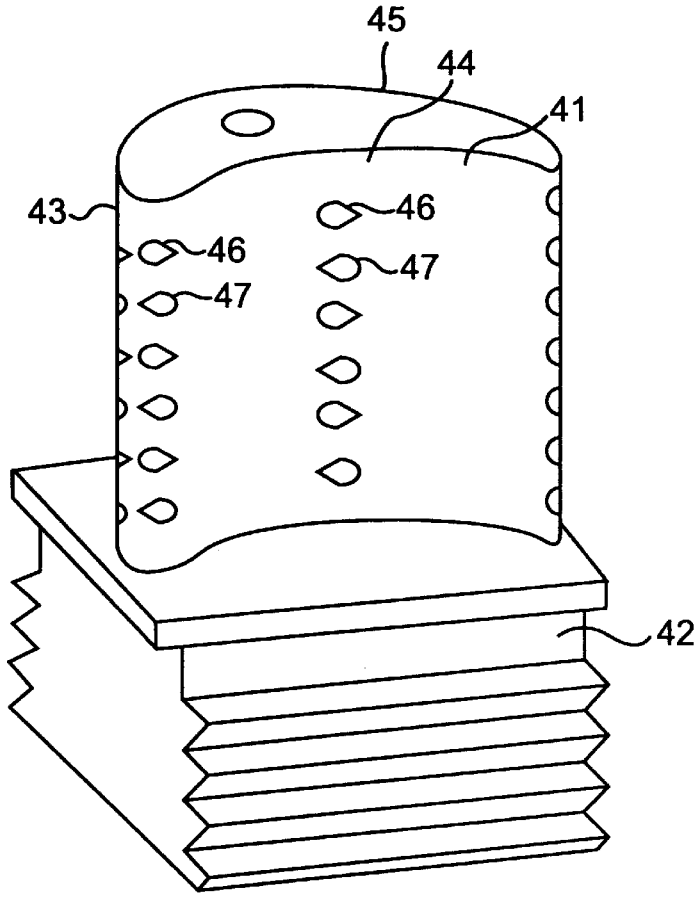

FIGS. 23A and 23B are schematic diagrams of the turbine blade including the coolant passages to which the first embodiment is applied. As shown in FIG. 23B, the turbine blade consists of a main body 41 of the blade and a base 42 to connect the main body 41 to a rotor (not shown). A plurality of coolant passages are formed in the base 42 and the main body 41. Each entrance of the coolant passage leads to a path of cooling fluid in the rotor. The cooling fluid flows through the coolant passage in the base 42 and the main body 41 and flows out from each outlet 46, 47. In FIG. 23B, the first outlet 46 and the second outlet 47 are mutually arranged along a direction perpendicular to the direction of the gas stream on the leading edge 43, body wall 44 and other wall 45. In this case, a center line of the first outlet 46 is inclined to the downstream side of the gas flow. A center line of the second outlet 47 is inclined to the upstream side. Referring to FIG. 23A, within each group of first outlets 46 or second outlets 47, the outlets 46 or 47 are located at approximately the same height above base 42. It is better that size of the first outlet 46 is equal to or larger than size of the second outlet 47.

Figure 1:
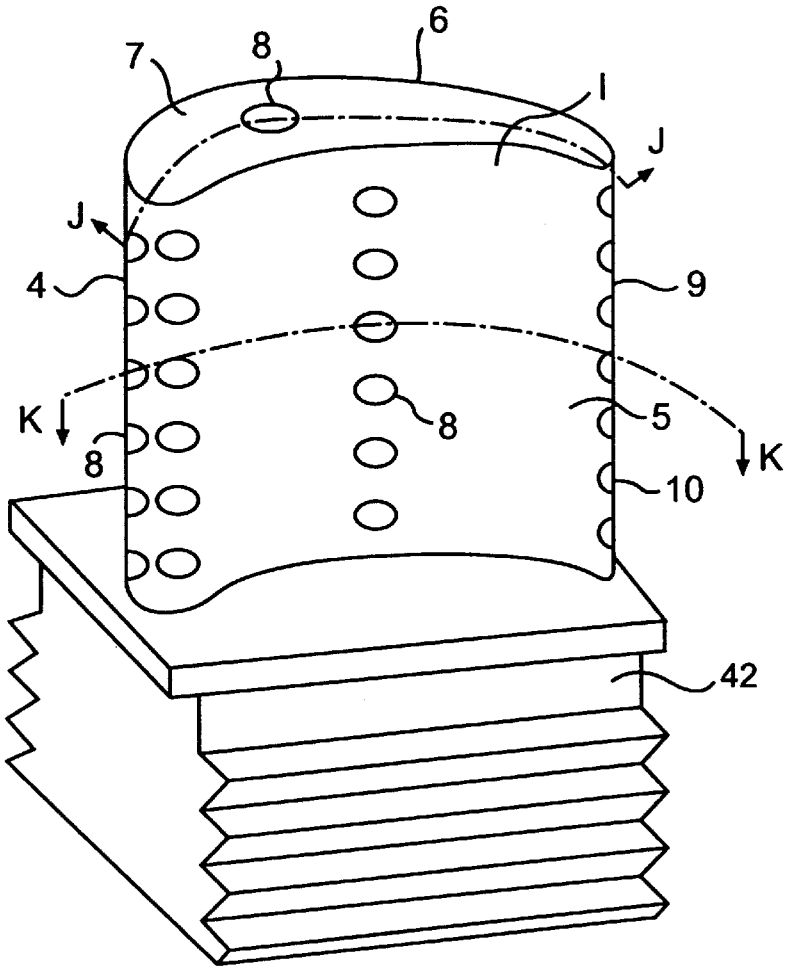
FIG. 1 (PRIOR ART)
FIG. 1 is a schematic diagram of the blade of a gas turbine according to the prior art.
Figure 2:
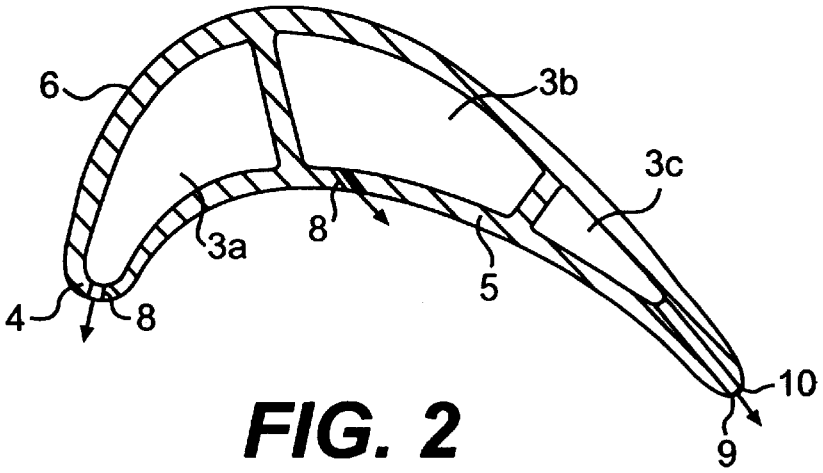
FIG. 2 (PRIOR ART)
FIG. 2 is a sectional plan of line K—K of FIG. 1.
Figure 3:
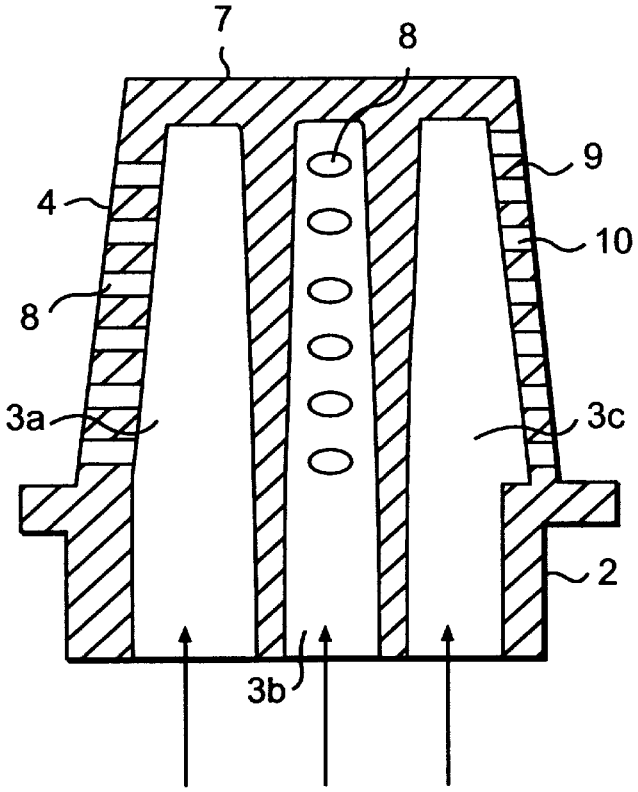
FIG. 3 (PRIOR ART)
FIG. 3 is a sectional plan of line J—J of FIG. 1.
Figure 4:
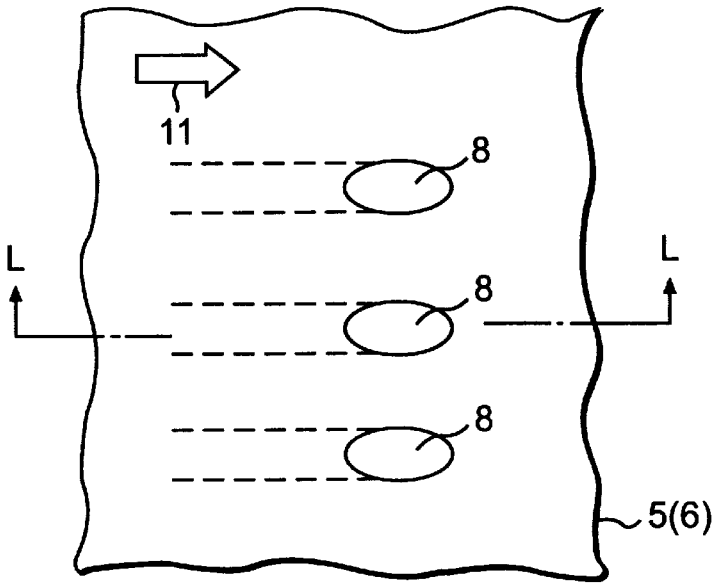
FIG. 4 (PRIOR ART)
FIG. 4 is a schematic diagram of the first example of the outlet of the coolant passage on the surface of the blade according to the prior art.
Figure 5:
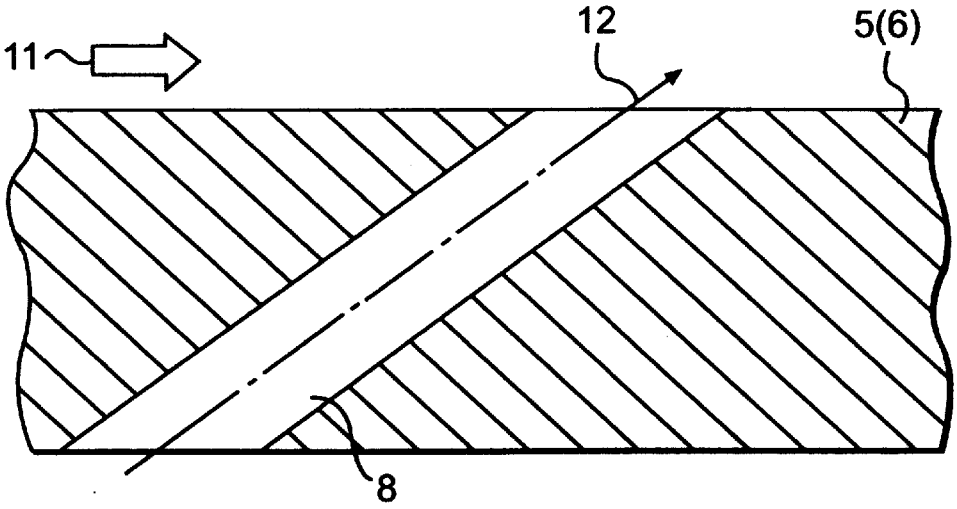
FIG. 5 (PRIOR ART)
FIG. 5 is a sectional plan of line L—L of FIG. 4.
Figure 6:
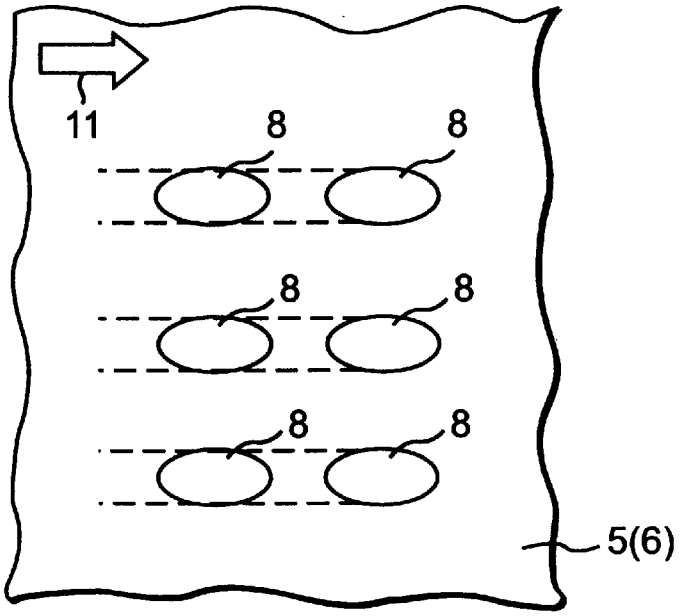
FIG. 6 (PRIOR ART)
FIG. 6 is a schematic diagram of the second example of the coolant passage on the surface of the blade according to the prior art.
Figure 7:
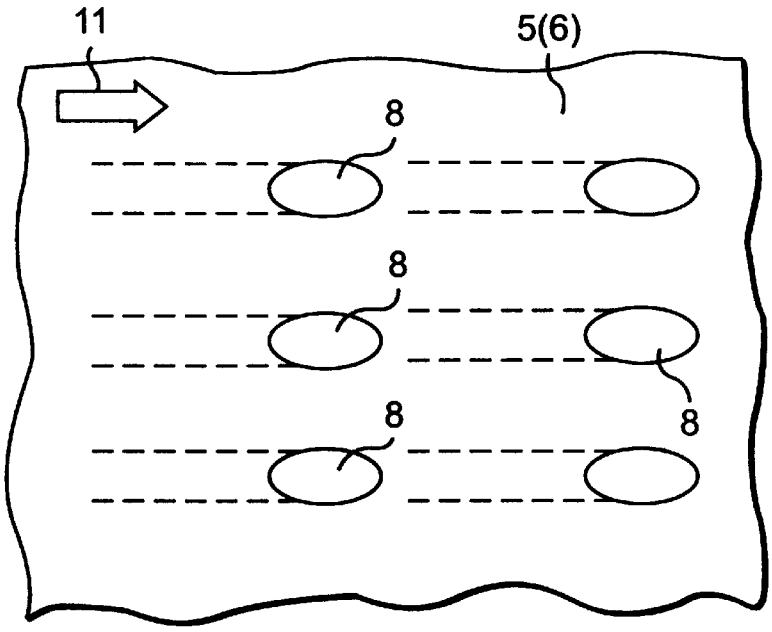
FIG. 7 (PRIOR ART)
FIG. 7 is a schematic diagram of the third example of the coolant passage on the surface of the blade according to the prior art.
Figure 8:
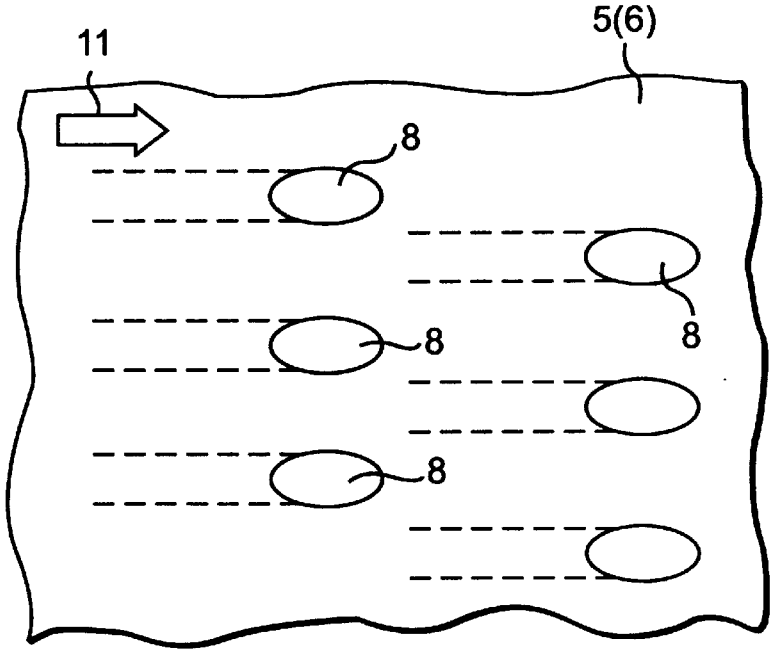
FIG. 8 (PRIOR ART)
FIG. 8 is a schematic diagram of the fourth example of the coolant passage on the surface of the blade according to the prior art.
Figure 9A:
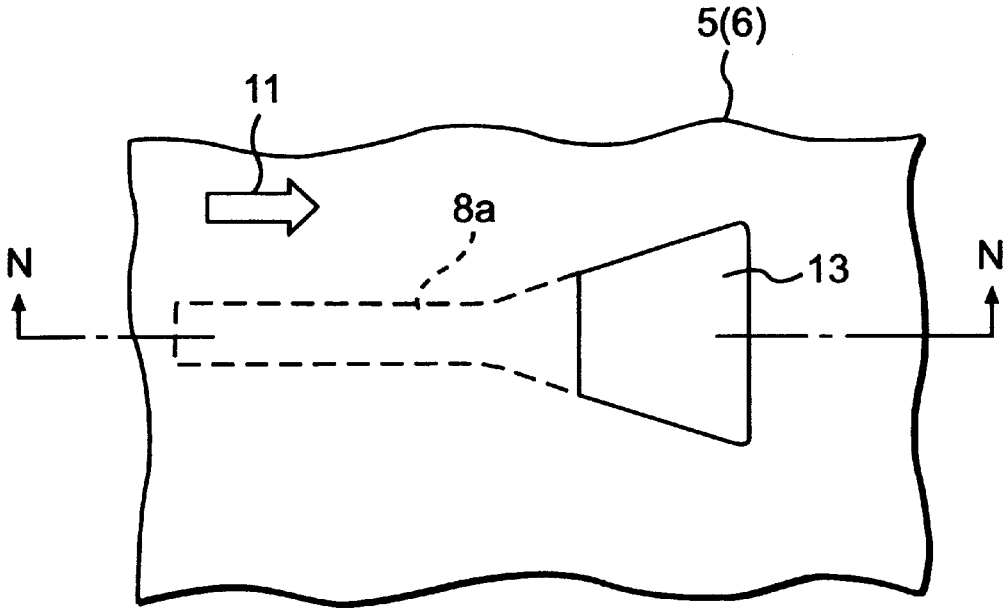
FIG. 9A (PRIOR ART)
FIG. 9A is a schematic diagram of the fifth example of the coolant passage on the surface of the blade according to the prior art.
Figure 9B:
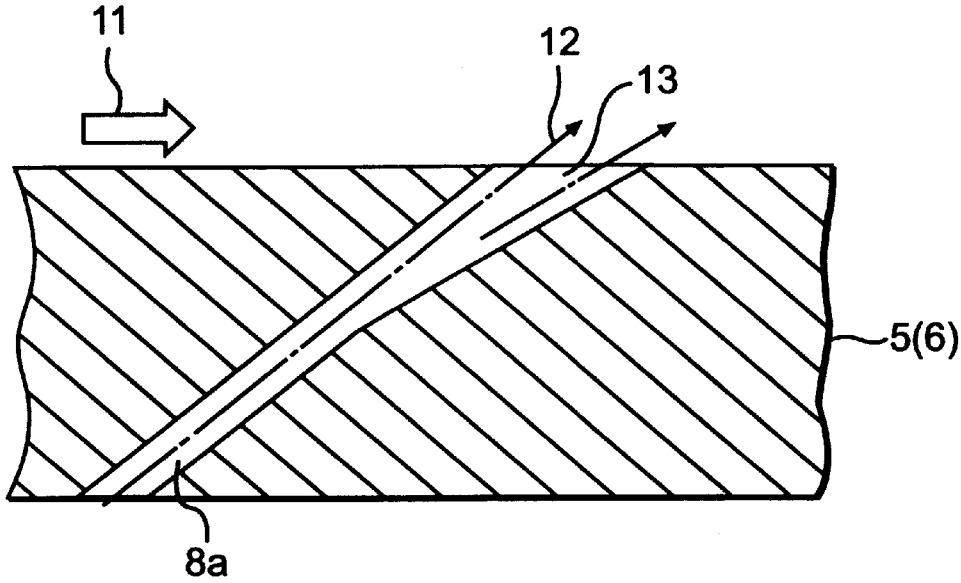
FIG. 9B (PRIOR ART)
FIG. 9B is a sectional plan of line N—N of FIG. 9A.
Figure 10:
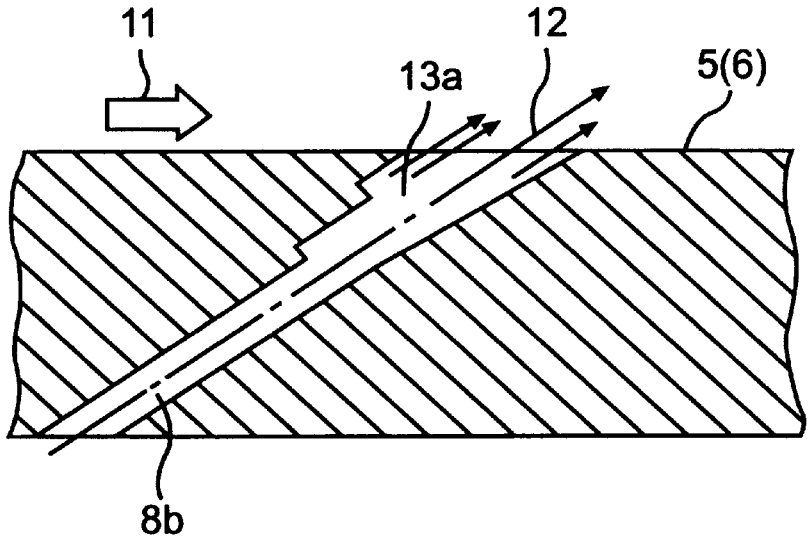
FIG. 10 (PRIOR ART)
FIG. 10 is a sectional plan of another construction of the fifth example.
Figure 11:
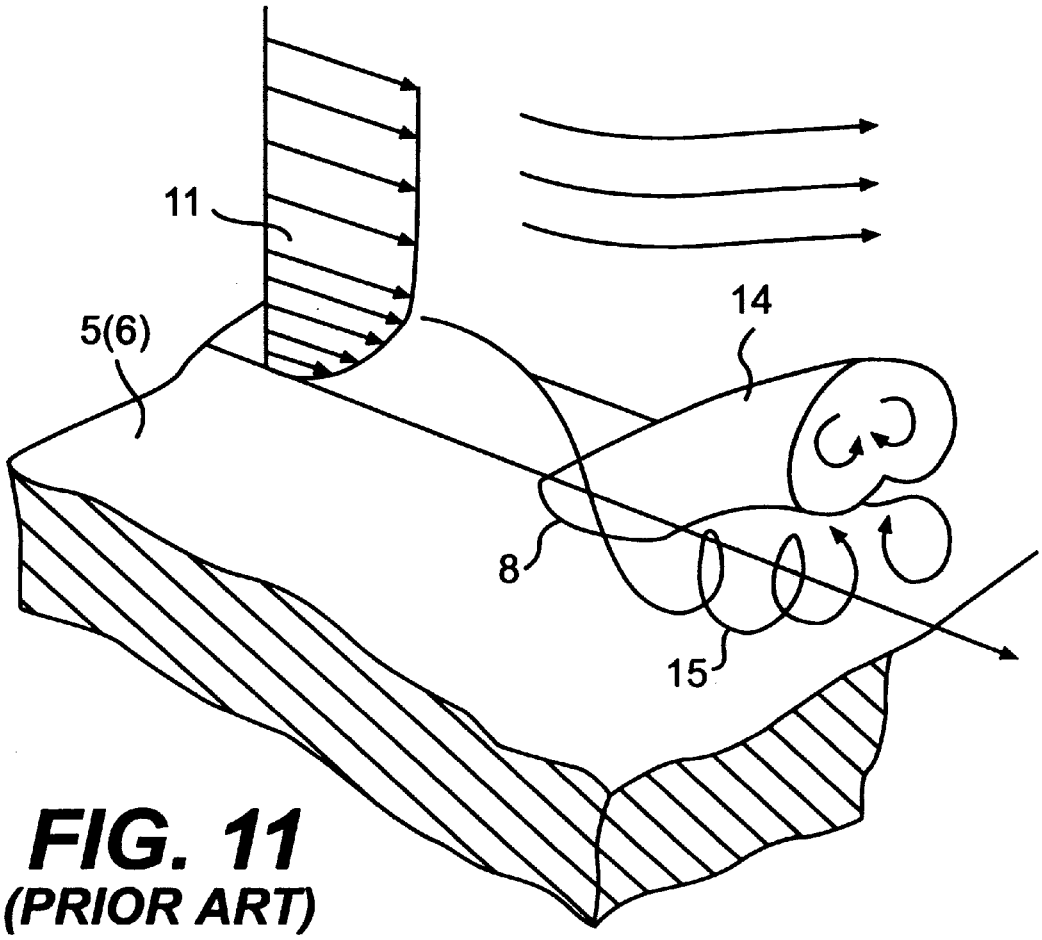
FIG. 11 (PRIOR ART)
FIG. 11 is a schematic diagram showing the problem of the outlet of the coolant passage according to the prior art.
Figure 12A:
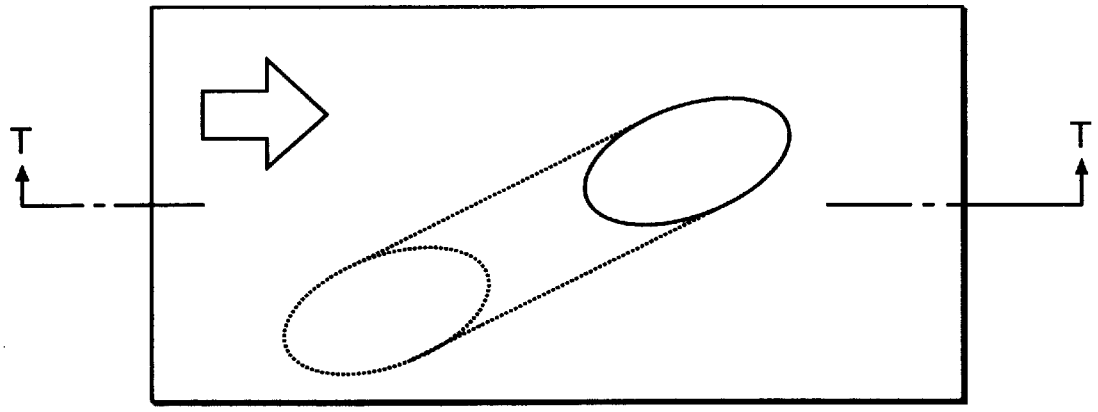
FIG. 12A (PRIOR ART)
FIG. 12A is a schematic diagram of the sixth example of the coolant passage on the surface of the blade according to the prior art.
Figure 12B:
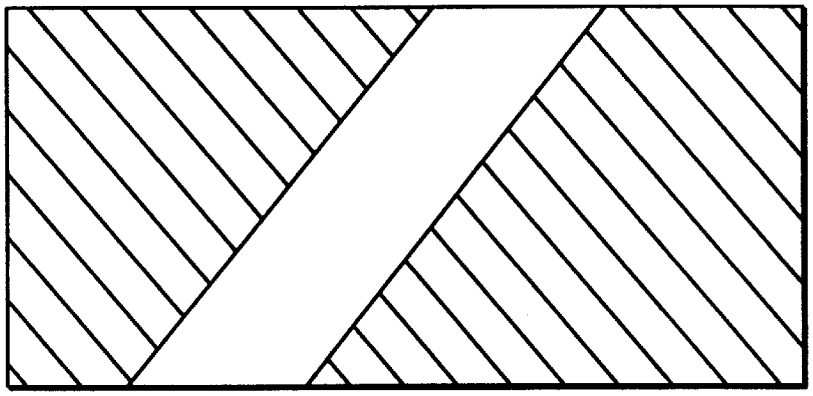
FIG. 12B (PRIOR ART)
FIG. 12B is a sectional plan of line T—T of FIG. 12A.
Figure 13A:
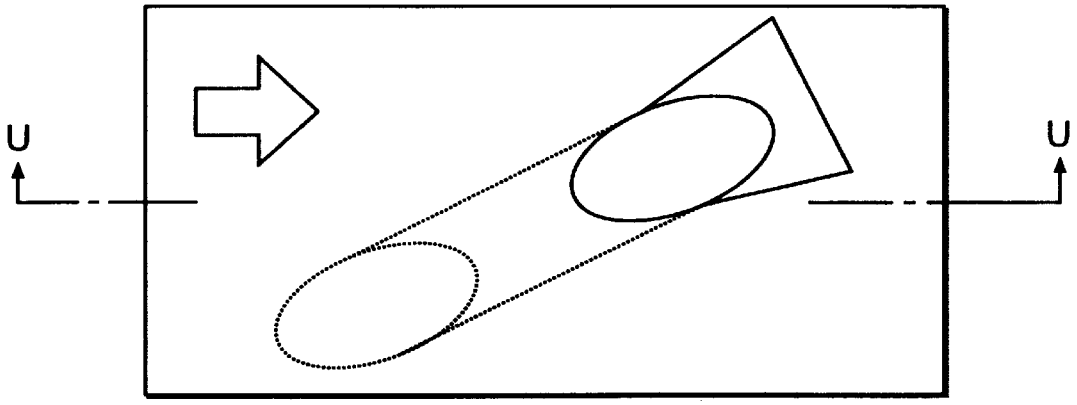
FIG. 13A (PRIOR ART)
FIG. 13A is a schematic diagram of seventh example of the coolant passage on the surface of the brade according to the prior art.
Figure 13B:
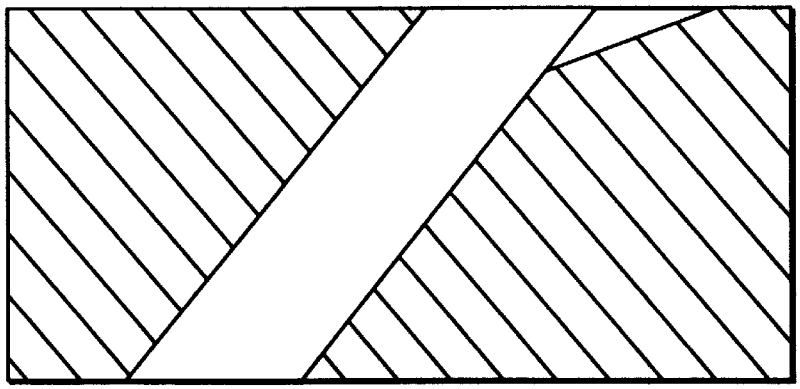
FIG. 13B (PRIOR ART)
FIG. 13B is a sectional plan of line U—U of FIG. 13A.
Figure 24:
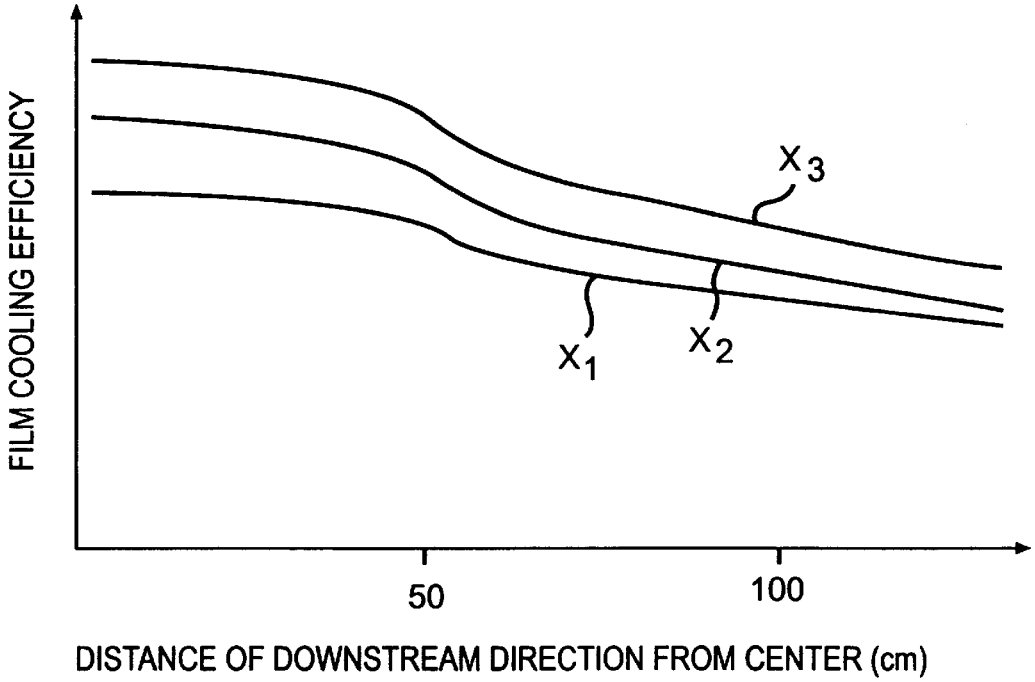
FIG. 24 is graph comparing the cooling efficiencies of the structures embodied in the present invention and the prior art.

FIG. 24 is a graph comparing the cooling efficiencies of the structures embodied in the the present invention and the prior art. In FIG. 24, X1 represents the film cooling efficiency of the outlet of the prior art shown in FIG. 7; X2 represents the film cooling efficiency of the outlet of the prior art shown in FIG. 8; X3 represents the film cooling efficiency of the outlet of the present invention shown in FIGS. 15A and 15B. According to the graph, the cooling efficiency of the present invention is greater in comparison with the prior art.

Figure 25A:
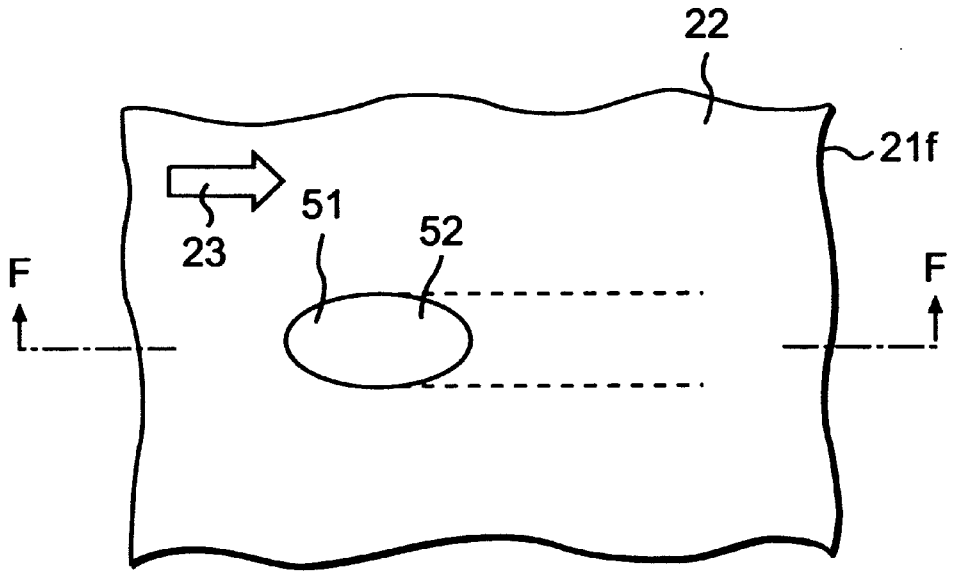
FIG. 25A is a schematic diagram of the outlet of the coolant passage on the surface of the blade according to a tenth embodiment of the present invention.
Figure 25B:
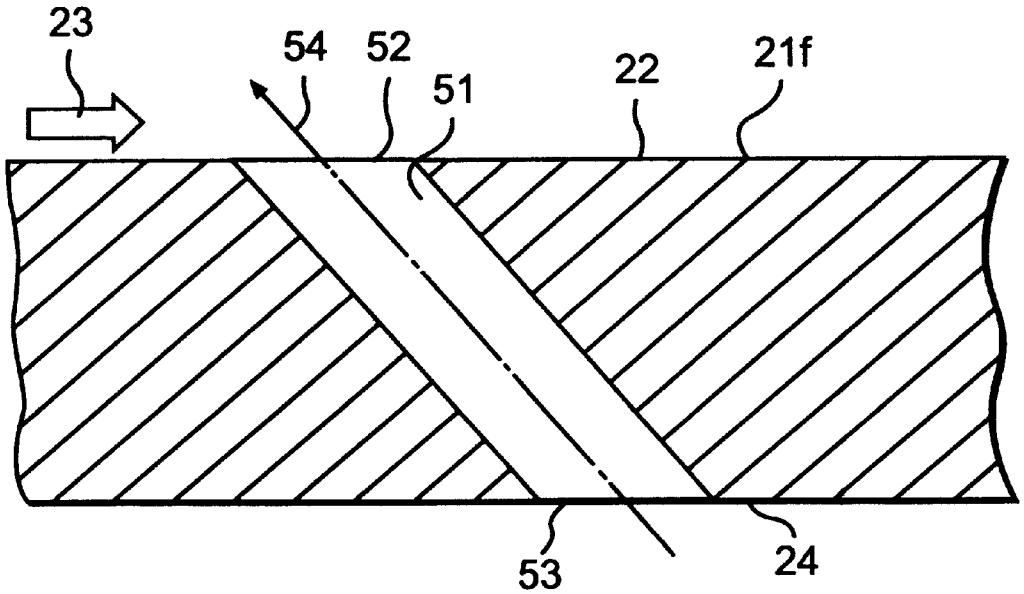
FIG. 25B is a sectional plan of line F—F of FIG. 25A.

FIG. 25A is a plan of an outlet of a coolant passage on the surface of the blade according to a tenth embodiment of the present invention. FIG. 25B is a sectional plan of line F—F of FIG. 25A. In the tenth embodiment, a plurality of one kind of outlet 52 (coolant passage 51) is set in the turbine blade 21*f*. One entrance of the coolant passage 51 is connected to supply section 53 of cooling fluid. Another entrance of the coolant passage 51 is opened as the outlet 52 on the surface 22. A center line 54 of the coolant passage 51 is inclined toward the upstream side of the gas flow. The shape of the outlet 52 may be circular or rectangular. The inclined angle of the coolant passage 51 is determined by the condition of the gas stream and the curvature ratio of the surface 22. In the structure of the tenth embodiment, the cooling fluid flowing from the outlet 52 collides with the gas stream 23. Therefore, the gas stream 23 does not roll up the cooling fluid in the downstream area. The gas stream 23 mixed with the cooling fluid flows, pushing the remaining cooling fluid downstream along the surface. Therefore, the cooling fluid film is well formed on the downstream area of the outlet 52.

Figure 26A:
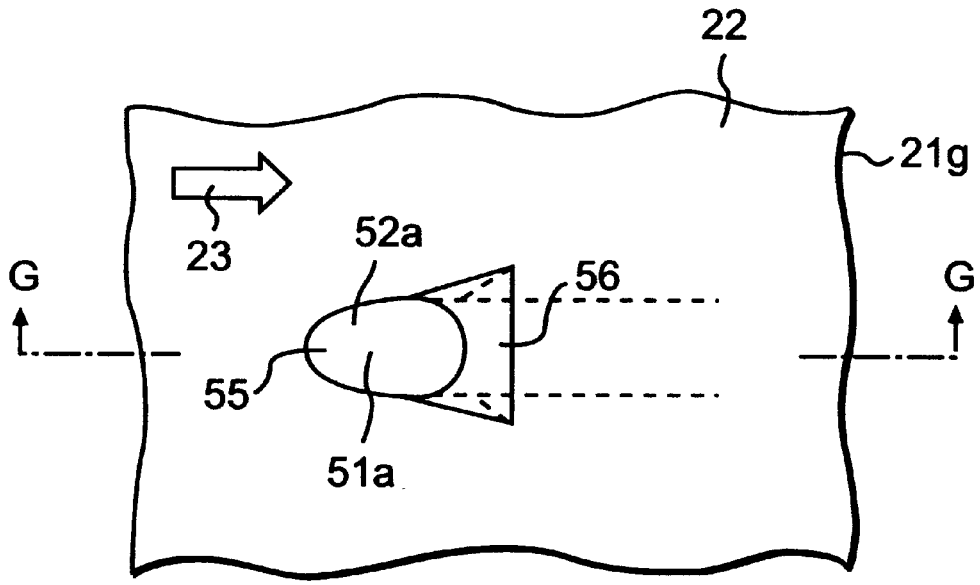
FIG. 26A is a schematic diagram of the outlet of the coolant passage on the surface of the blade according to an eleventh embodiment of the present invention.
Figure 26B:
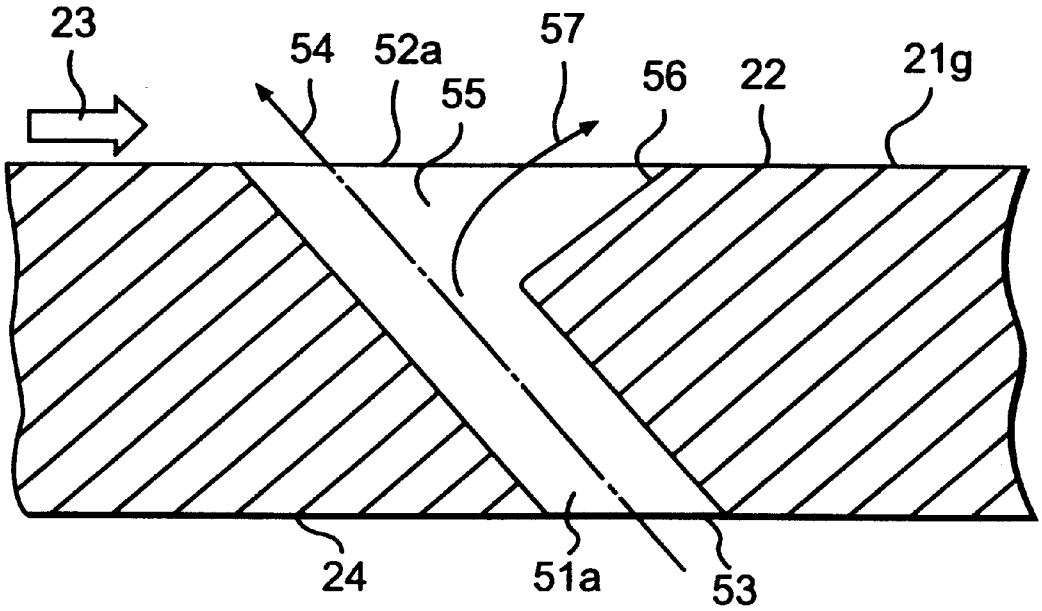
FIG. 26B is a sectional plan of line G—G of FIG. 26A.

FIG. 26A is a plan of an outlet of a coolant passage on the surface of the blade according to an eleventh embodiment of the present invention. FIG. 26B is a sectional plan of line G—G of FIG. 26A. In the eleventh embodiment, a diffusion outlet 56 is formed on the outlet 55. As shown in FIG. 26B, the diffusion outlet 56 occupies part of the downstream side of the inner wall of the coolant passage 51*a*. The downstream side of the inner wall from the surface 22 to predetermined length along a direction of the coolant passage is inclined in the downstream direction. In this structure, the quantity of cooling fluid flowing along arrow 54 (upstream side) is larger than the quantity of cooling fluid flowing along arrow 57 (downstream side). In the area where the movement of the gas stream is rapid such as the downstream area of the stagnation region, the quantity of the cooling fluid to the downstream area is preferably smaller than the quantity of the cooling fluid to the upstream area. This structure is suitable for the area on which gas stream flows with accelerated speed.

Figure 27A:
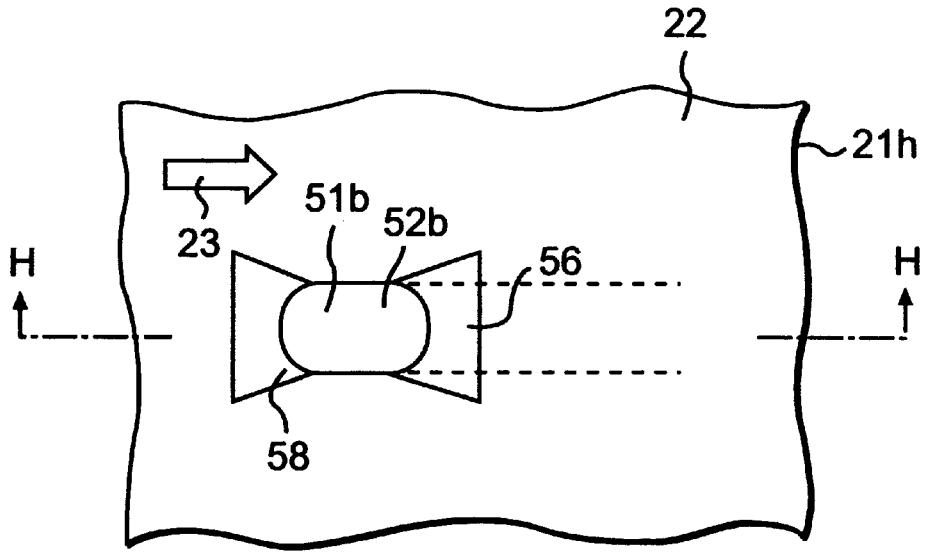
FIG. 27A is a schematic diagram of the outlet of the coolant passage on the surface of the blade according to a twelfth embodiment of the present invention.
Figure 27B:
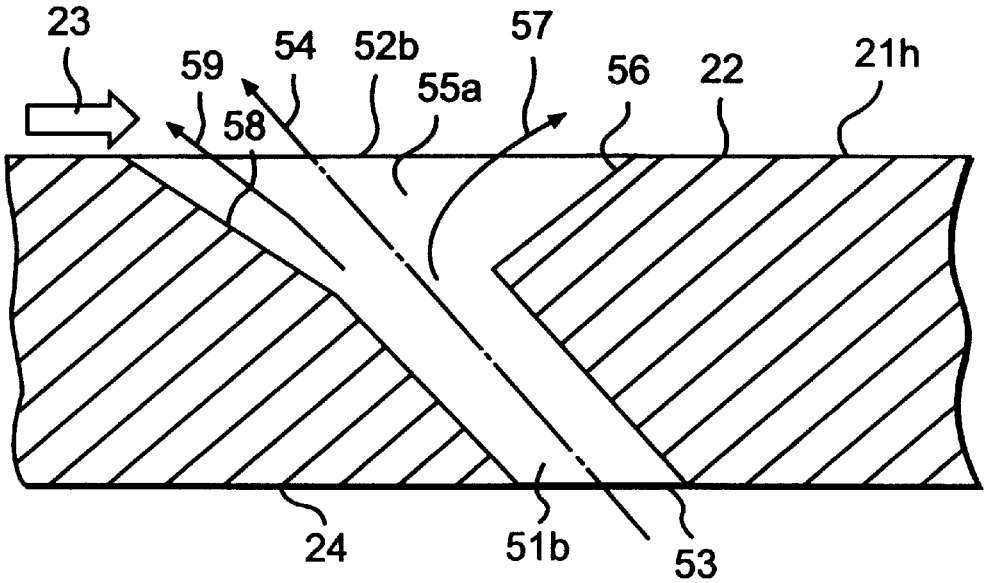
FIG. 27B is a sectional plan of line H—H of FIG. 27A.

FIG. 27A is a plan of an outlet of a coolant passage on the surface of the blade according to a twelfth embodiment of the present invention. FIG. 27B is a sectional plan of line H—H of FIG. 27A. In the twelfth embodiment, in addition to structure of the eleventh embodiment, a diffusion outlet 58 is formed on the upstream side of the outlet 52*b*. As shown in FIG. 27B, the diffusing outlet 58 occupies part of the upstream side of the inner wall of the coolant passage 51*b*. In short, the upstream side of the inner wall is inclined in the upstream direction from the surface 22 to a predetermined length along a direction of the coolant passage. In this structure, in addition to the effect of the eleventh embodiment, the cooling fluid flows to the upstream side along an arrow 59 and the quantity of the cooling fluid flowing to the upstream side increases. Therefore, the mix between the gas stream 23 and the cooling fluid is high for areas where the movement of the gas stream is rapid. The inclination of the angle of the diffusion outlets 56, 58 is determined by the condition of the gas stream and curvature ratio of the surface 22.

Figure 28A:
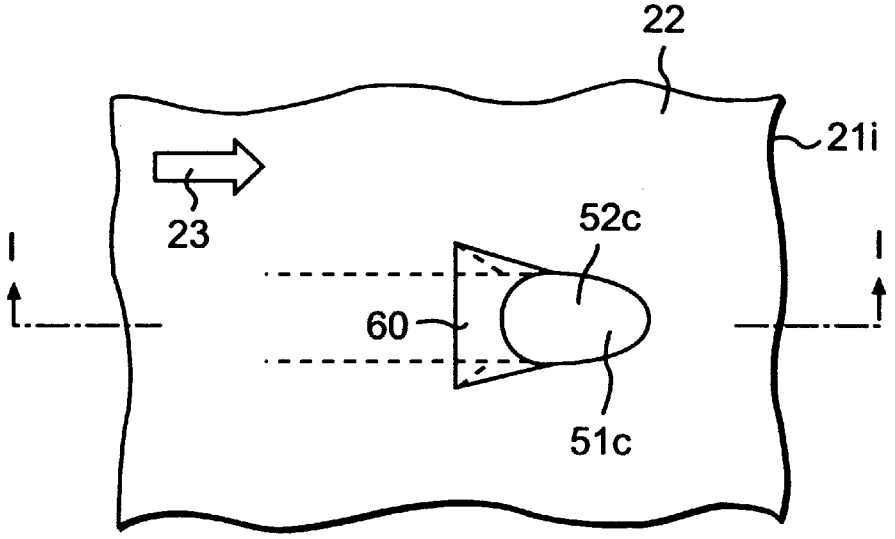
FIG. 28A is a schematic diagram of the outlet of the coolant passage on the surface of the blade according to a thirteenth embodiment of the present invention.
Figure 28B:
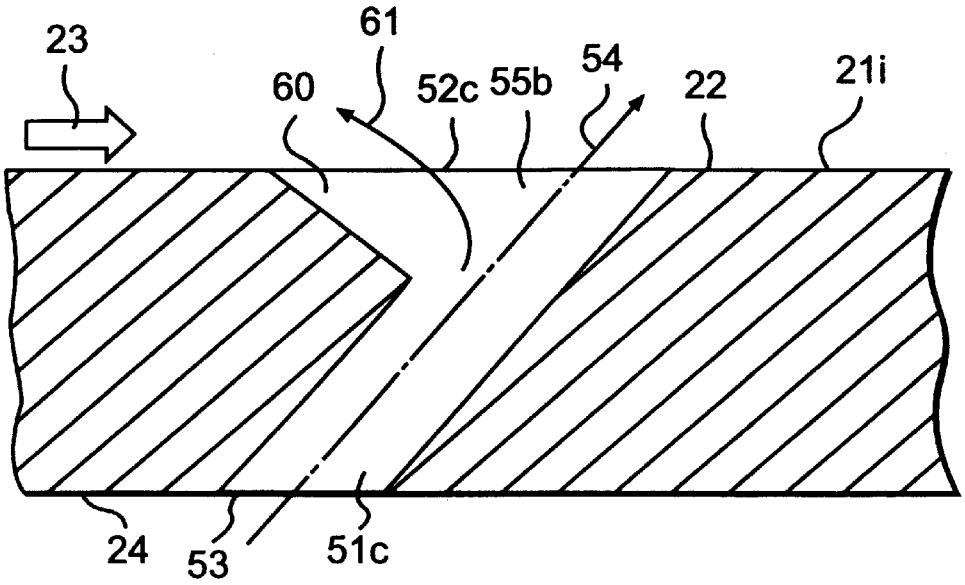
FIG. 28B is a sectional plan of line I—I of FIG. 28A.

FIG. 28A is a plan of an outlet of a coolant passage on the surface of the blade according to a thirteenth embodiment of the present invention. FIG. 28B is a sectional plan of line I—I of FIG. 28A. In the thirteenth embodiment, a center line 54 of the coolant passage 51C is inclined to the downstream side on the surface 22. A diffusion outlet 60 is formed on the upstream side of the outlet 52C. As shown in FIG. 28B, the diffusing outlet 60 occupies part of the upstream side of the inner wall of the coolant passage 51C. In short, the upstream side of the inner wall is inclined in the upstream direction from the surface 22 to predetermined length along the direction of the coolant passage. In this structure, a part of the cooling fluid flows along the arrow 61 to the upstream side. In addition, the cooling fluid flows along the arrow 54 to the downstream side. Film coverage is widely spread on the downstream side of the outlet 52C. The inclination of the angle of the diffusion outlet 60 is determined by the condition of the gas stream and the curvature ratio of the surface 22.

Figure 29:
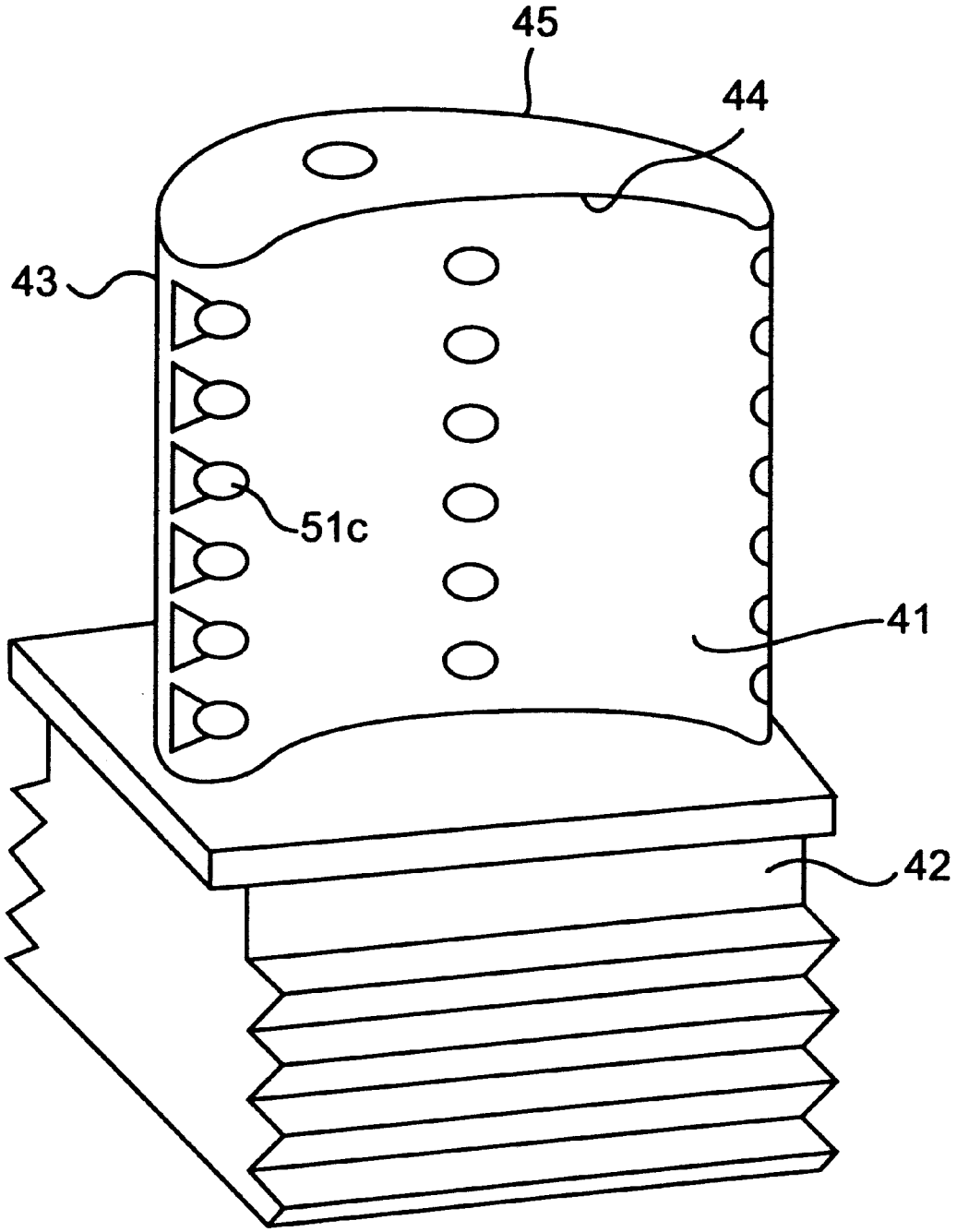
FIG. 29 is a schematic diagram of the turbine blade including the coolant passage according to the thirteenth embodiment.

FIG. 29 is a schematic diagram of the turbine blade including the coolant passage according to the thirteenth embodiment. In FIG. 29, the outlet 51C of FIG. 28A is applied to the front wall 43 of the turbine blade 41.

Figure 30A:
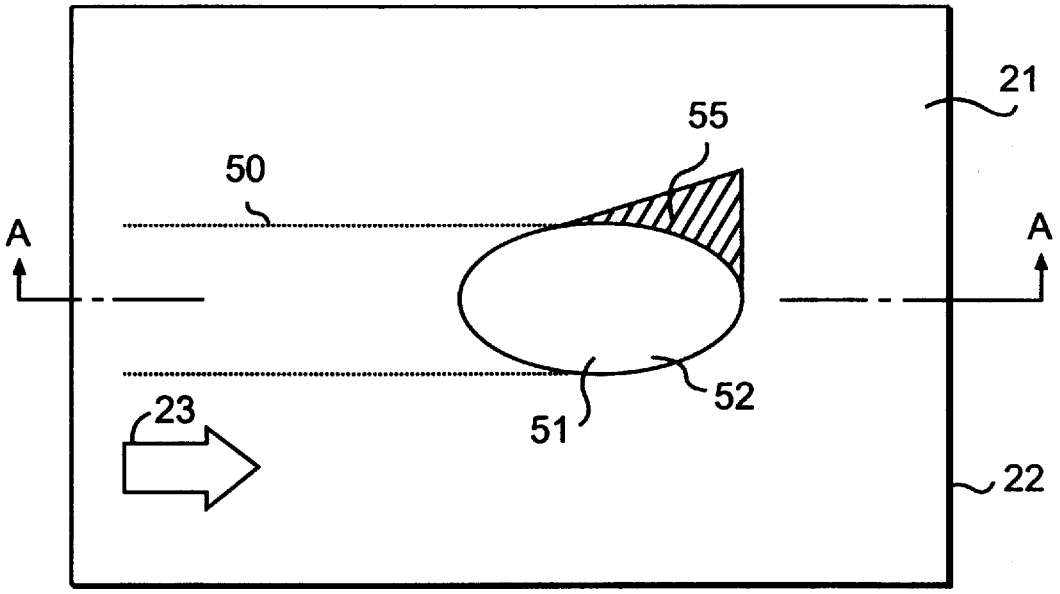
FIG. 30A is a schematic diagram of the outlet of the coolant passage on the surface of the blade according to a fourteenth embodiment of the present invention.
Figure 30B:
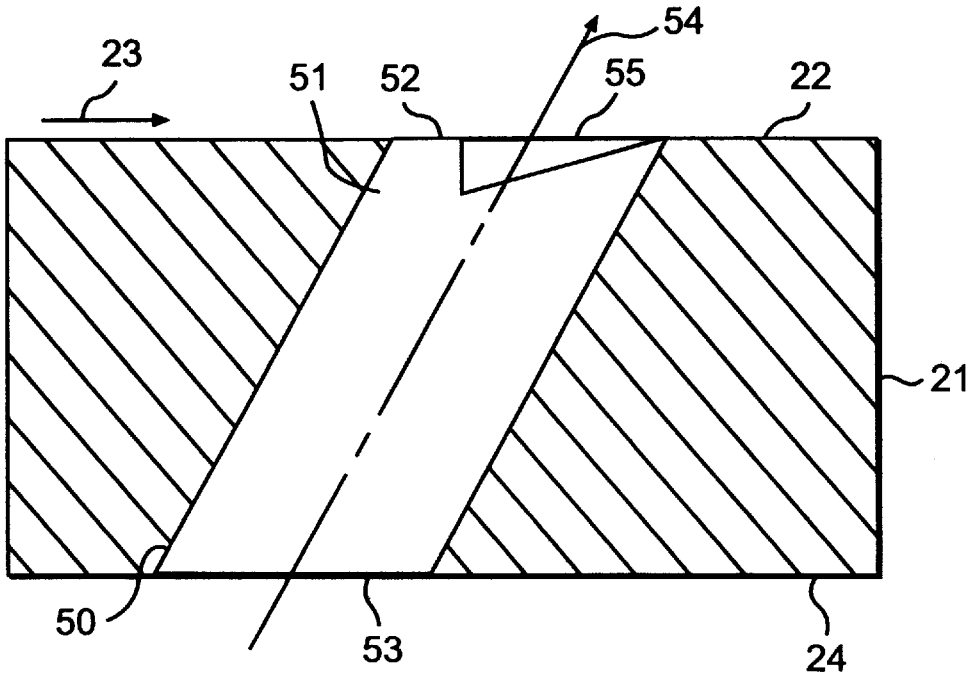
FIG. 30B is a sectional plan of line A—A line of FIG. 30A.

FIG. 30A is a plan of an outlet of a coolant passage on the surface of the blade according to a fourteenth embodiment of the present invention. FIG. 30B is a sectional plan of line A—A of FIG. 30A. In the fourteenth embodiment, a plurality of the outlets 52 of the coolant passage 51 are arranged in a direction perpendicular to the gas flow 23 (only one outlet 52 is shown in FIG. 30A). A center line 54 of the coolant passage 51 is inclined to the downstream side of the gas flow 23. A diffusion outlet 55 is formed on the outlet 52. The shape of the diffusing outlet 55 is inclined to laterally and vertically in the direction of the gas flow. In this structure, the cooling fluid flows from the outlet 52 along the center line 54 to the downstream side. A part of the cooling fluid flows from the diffusion outlet 55 to the lateral direction. That part of the cooling fluid collides with the gas stream from a direction perpendicular to the gas flow 23. Therefore, the gas stream roll-up of the cooling fluid flowing to the downstream side is avoided. Furthermore, the cooling fluid is spread widely on the downstream area and the temperature is distributed uniformly on the downstream area.

Figure 31A:
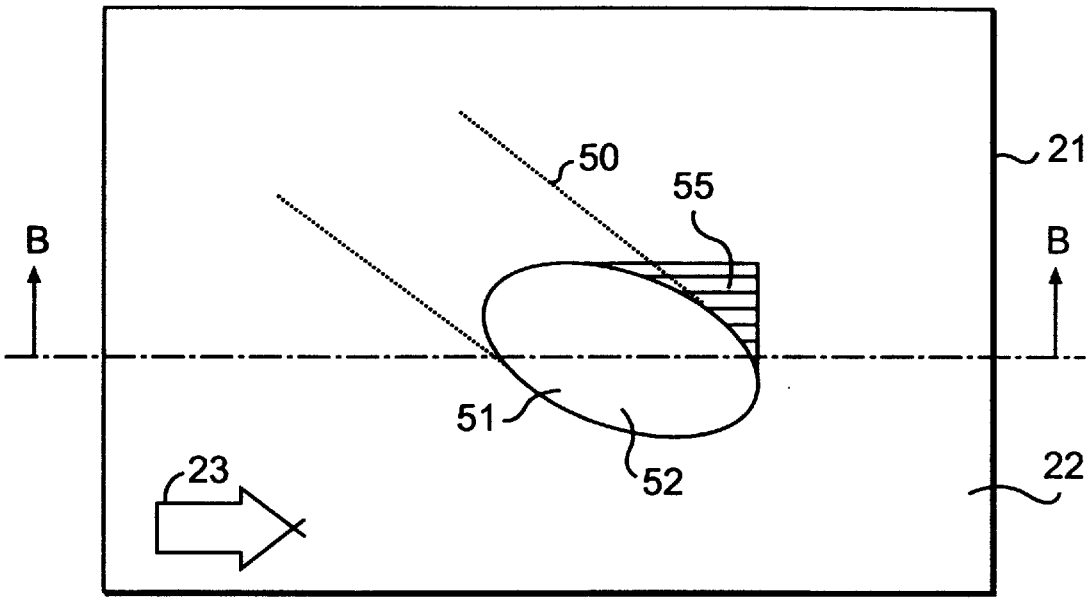
FIG. 31A is a schematic diagram of the outlet of the coolant passage on the surface of the blade according to a fifteenth embodiment of the present invention.
Figure 31B:
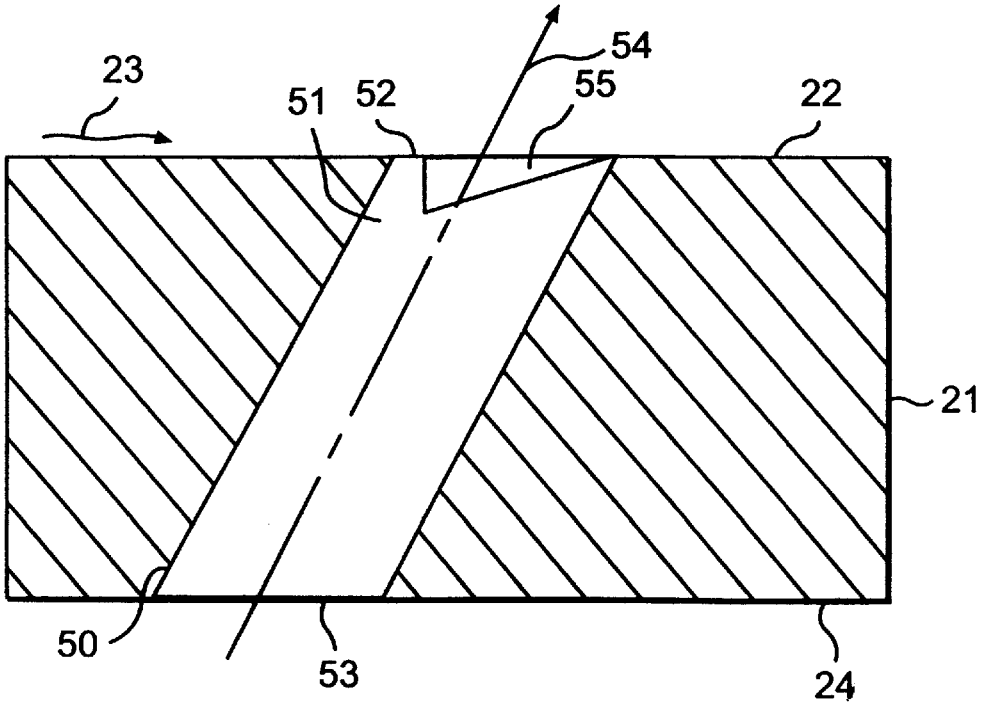
FIG. 31B is a sectional plan of line B—B of FIG. 31A.

FIG. 31A is a plan of an outlet of a coolant passage on the surface of the blade according to a fifteenth embodiment of the present invention. FIG. 31B is a sectional plan of line B—B of FIG. 31A. In the fifteenth embodiment, the center line 54 of the coolant passage 51 is inclined in lateral direction of the downstream side of the gas flow. The diffusing outlet 55 is formed on the outlet 52. The shape of the diffusion outlet 55 is inclined vertically in the direction of the gas flow 23. In this structure, the cooling fluid flows from the outlet 52 along the center line 54 to the downstream side. A part of the cooling fluid flows from the diffusion outlet 55 to the downstream side. The cooling fluid collides with the gas stream from a direction inclined to the gas flow 23. Therefore, the gas stream roll-up the cooling fluid flowing to the downstream side is avoided. Furthermore, the cooling fluid is spread widely on the downstream area, and the temparature is distributed uniformly on the downstream area.

Figure 32A:
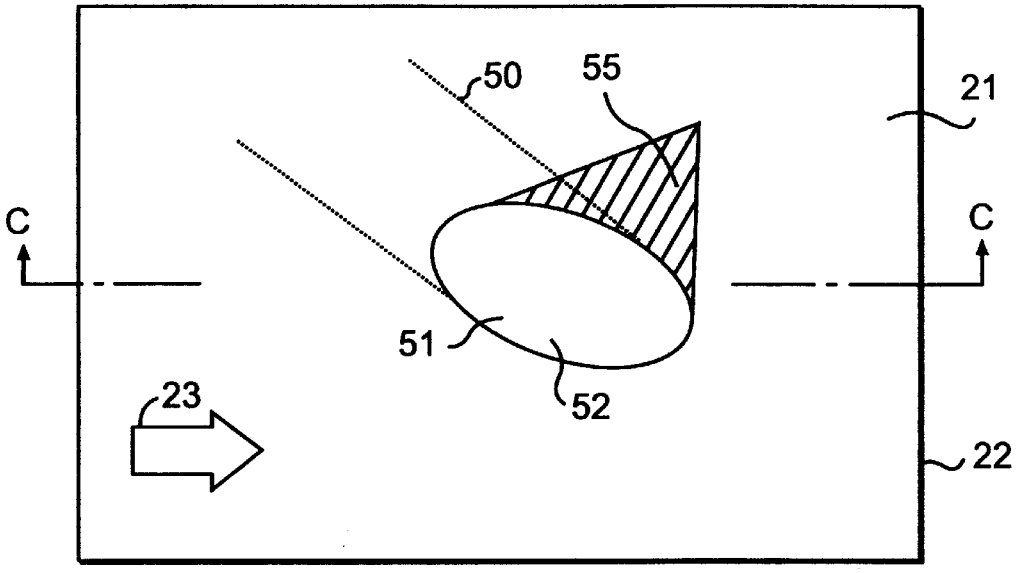
FIG. 32A is a schematic diagram of the outlet of the coolant passage on the surface of the blade according to a sixteenth embodiment of the present invention.
Figure 32B:
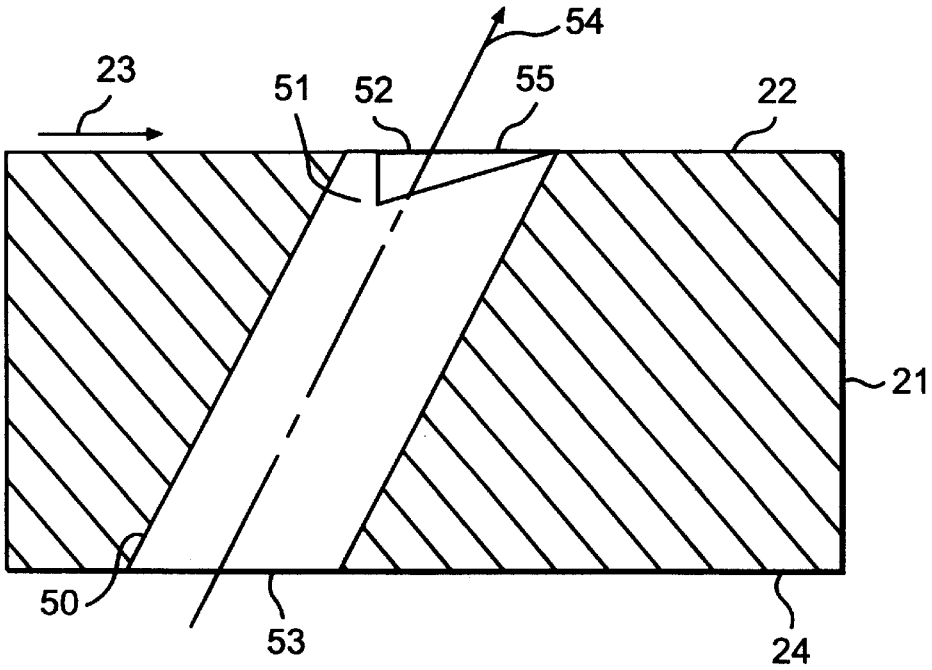
FIG. 32B is a sectional plan of line C—C of FIG. 32A.

FIG. 32A is a plan of an outlet of a coolant passage on the surface of the blade according to a sixteenth embodiment of the present invention. FIG. 32B is a sectional plan of line C—C of FIG. 32A. In the sixteenth embodiment, the center line 54 of the coolant passage 51 is inclined in a lateral direction of the downstream side of the gas flow 23. The diffusion outlet 55 is formed on the outlet 52. The shape of the diffusion outlet 55 inclined laterally and vertically in the direction of the gas flow 23. In this structure, the cooling fluid flows from the outlet 52 along the center line 54 to the downstream side. A part of the cooling fluid flows from the diffusion outlet 55 to the downstream side. The cooling fluid collides with the gas stream from a direction inclined to the gas flow 23. Therefore, the gas stream roll-up the cooling fluid flowing to the downstream side is avoided. Furthermore, the cooling fluid is spread widely on the downstream area and the temparature is uniformly distributed on the downstream area.

Figure 33A:
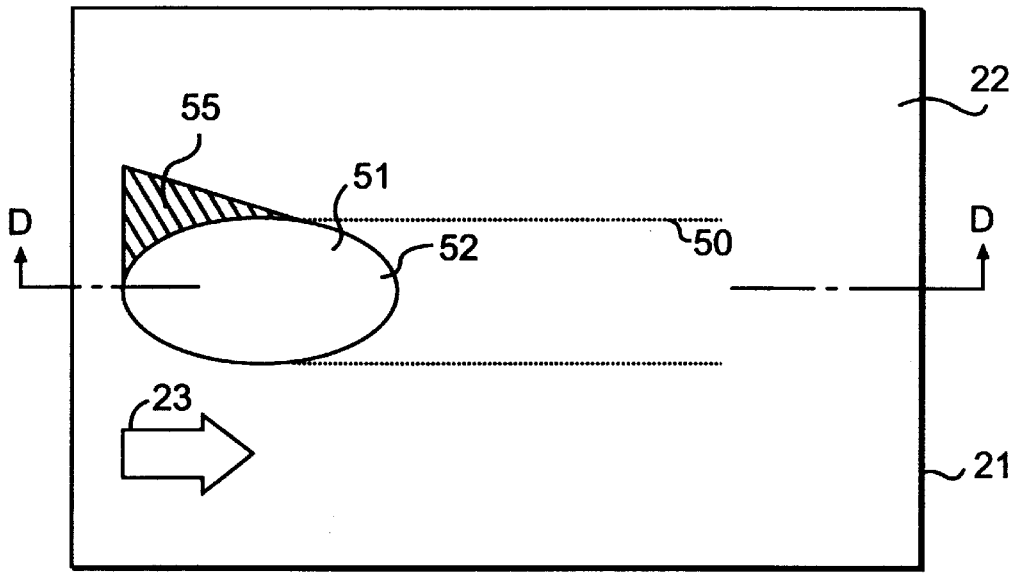
FIG. 33A is a schematic diagram of the outlet of the coolant passage on the surface of the blade according to a seventeenth embodiment of the present invention.
Figure 33B:
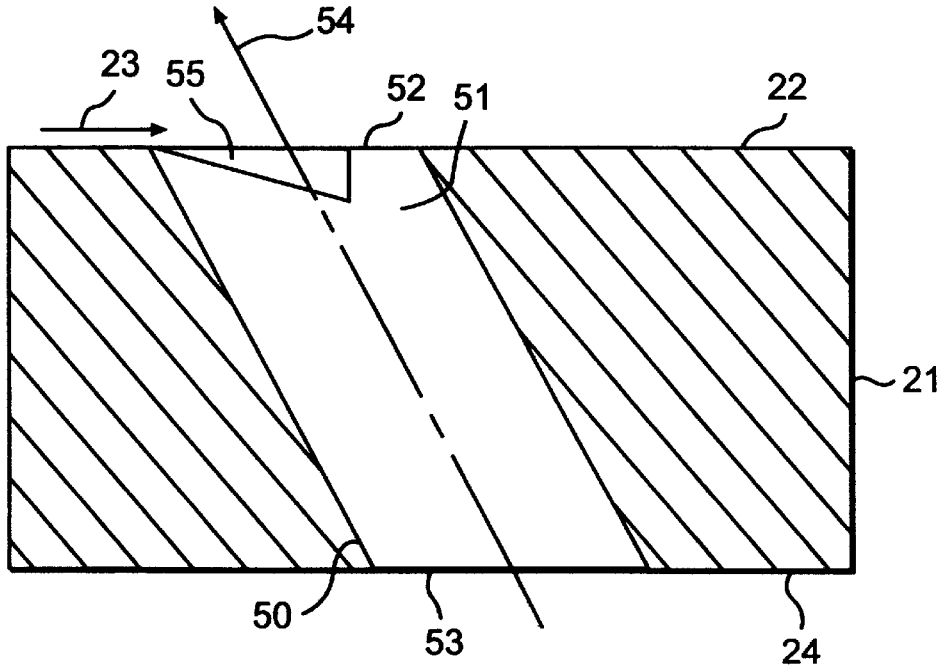
FIG. 33B is a sectional plan of line D—D of FIG. 33A.

FIG. 33A is a plan of an outlet of a coolant passage on the surface of the blade according to a seventeenth embodiment of the present invention. FIG. 33B is a sectional plan of line D—D of FIG. 33A. In the seventeenth embodiment, the center line 54 of the coolant passage 51 is inclined in the upstream side of the gas flow 23. The diffusion outlet 55 is partially formed on the outlet 52. The shape of the diffusing outlet 55 is inclined laterally and vertically in the direction of the gas flow 23. In this structure, the cooling fluid flows from the outlet 52 along the center line 54 to the upstream side. A part of the cooling fluid flows from the diffusing outlet 55 in the lateral direction. This part of the cooling fluid collides with the gas stream from a direction perpendicular to the gas flow 23. Therefore, the gas stream roll-up the cooling fluid flowing to the downstream side is avoided. Furthermore, the cooling fluid is spread widely on the downstream area and the temparature is distributed uniformly on the downstream area.

Figure 34A:
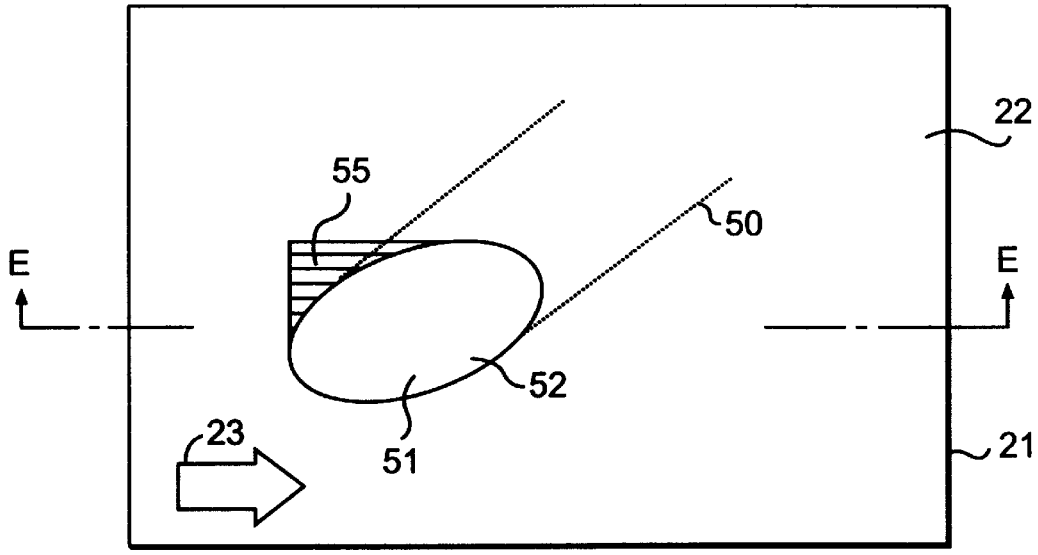
FIG. 34A is a schematic diagram of the outlet of the coolant passage on the surface of the blade according to an eighteenth embodiment of the present invention.
Figure 34B:
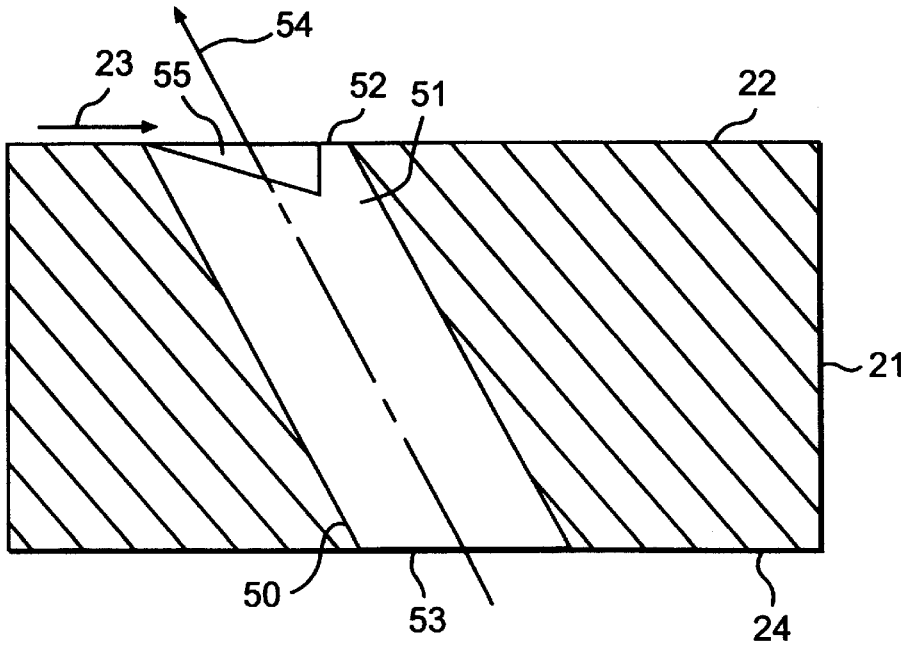
FIG. 34B is a sectional plan of line E—E of FIG. 34A.

FIG. 34A is a plan of an outlet of a coolant passage on the surface of the blade according to an eighteenth embodiment of the present invention. FIG. 34B is a sectional plan of line E—E of FIG. 34A. In the eighteenth embodiment, the center line 54 of the coolant passage 51 is inclined laterally in the direction of the upstream side in relation to the gas flow 23. The diffusion outlet 55 is partially formed on the outlet 52. The shape of the diffusion outlet 55 is inclined vertically in the direction of the the gas flow 23. In this structure, the cooling fluid flows from the outlet 52 along the center line 54 in the lateral direction of the upstream side. A part of the cooling fluid flows from the diffusion outlet 55 to the upstream side. This part of the cooling fluid collides with the gas stream. Therefore, the gas stream roll-up of the cooling fluid flowing to the downstream side is avoided. Furthermore, the cooling fluid is spread widely on the downstream area and the temparature is uniformly distributed on the downstream area.

Figure 35A:
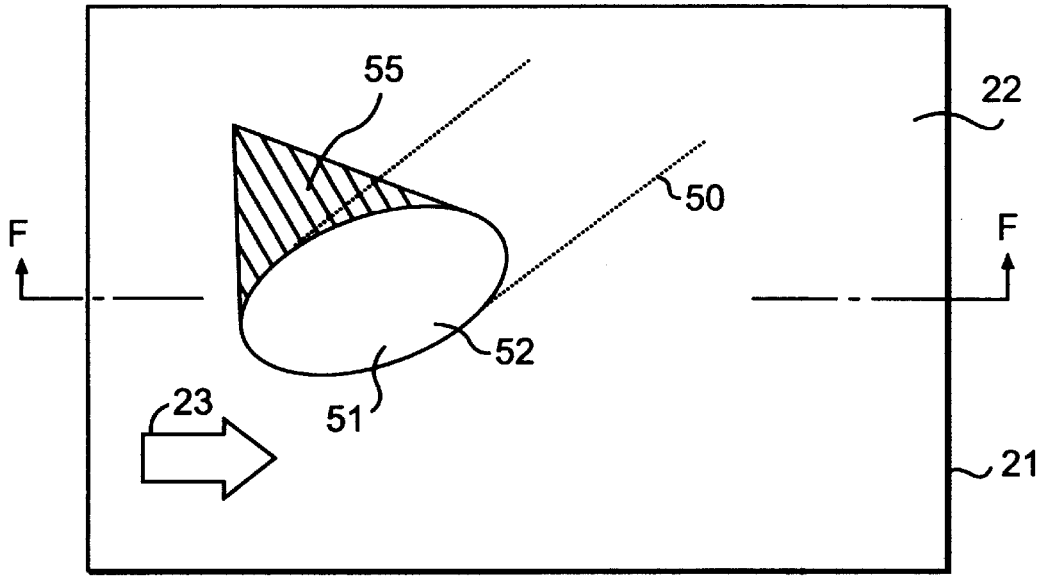
FIG. 35A is a schematic diagram of the outlet of the coolant passage on the surface of the blade according to a nineteenth embodiment of the present invention.
Figure 35B:
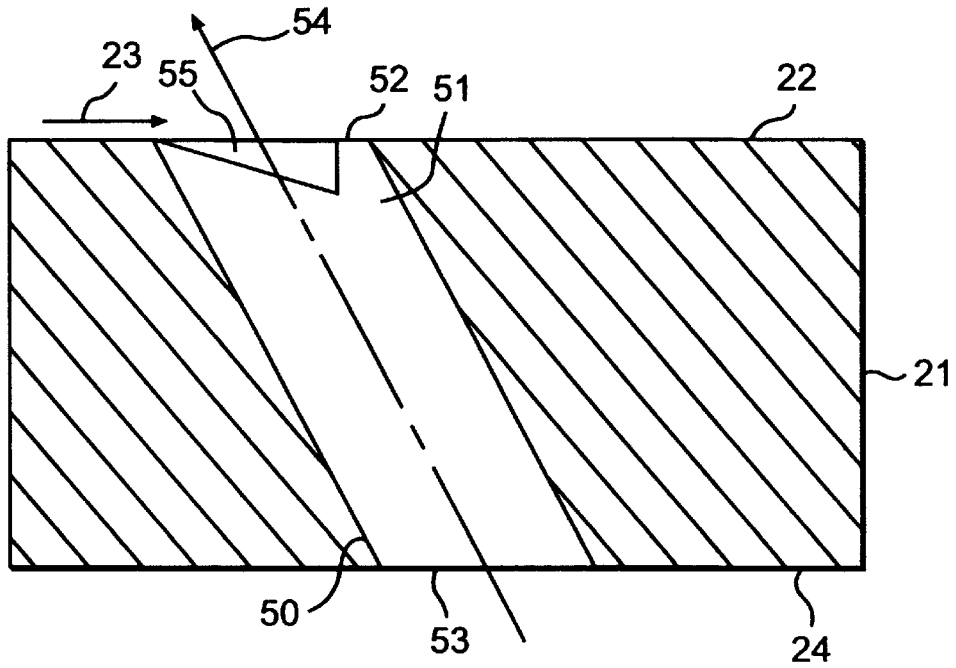
FIG. 35B is a sectional plan of line F—F of FIG. 35A.

FIG. 35A is a plan of an outlet of a coolant passage on the surface of the blade according to a nineteenth embodiment of the present invention. FIG. 35B is a sectional plan of line F—F of FIG. 35A. In the nineteenth embodiment, the center line 54 of the coolant passage 51 is inclined laterally in the direction of the upstream side of the gas flow 23. The diffusion outlet 55 is partially formed on the outlet 52. The shape of the diffusion outlet 55 is inclined laterally and vertically in the direction of the gas flow 23. In this structure, the cooling fluid flows from the outlet 52 along the center line 54 in the lateral direction of the upstream side. A part of the cooling fluid flows from the diffusion outlet 55 to the upstream side. The cooling fluid collides with the gas stream from a direction inclined to the gas flow 23. Therefore, the gas stream roll-up of the cooling fluid flowing to the downstream side is avoided. Furthermore, the cooling fluid is widely spread on the downstream area and the temparature is distributed uniformly on the downstream area.

Figure 36A:
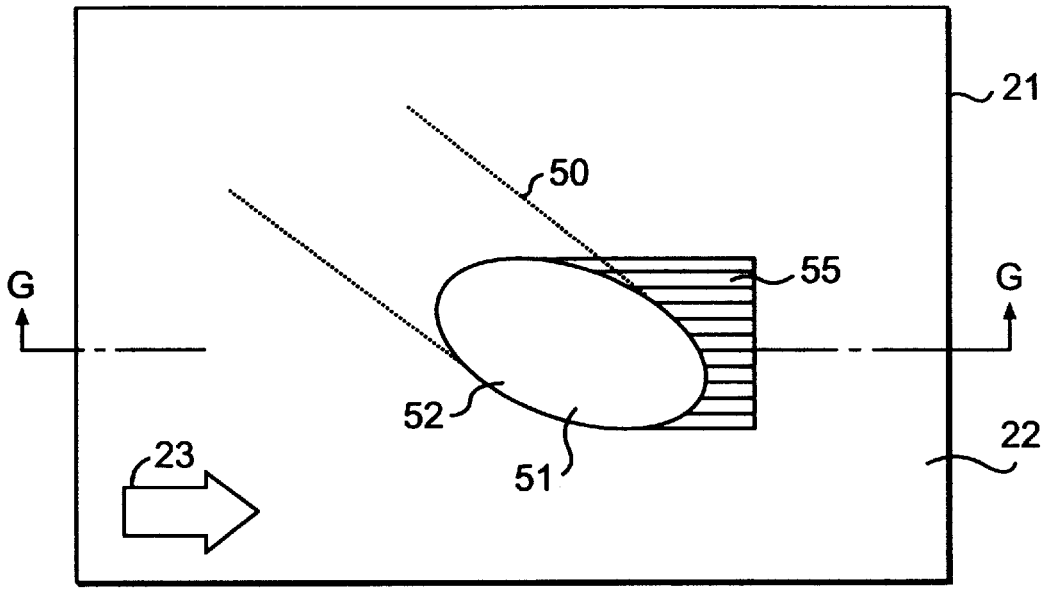
FIG. 36A is a schematic diagram of the outlet of the coolant passage on the surface of the blade according to a twentieth embodiment of the present invention.
Figure 36B:
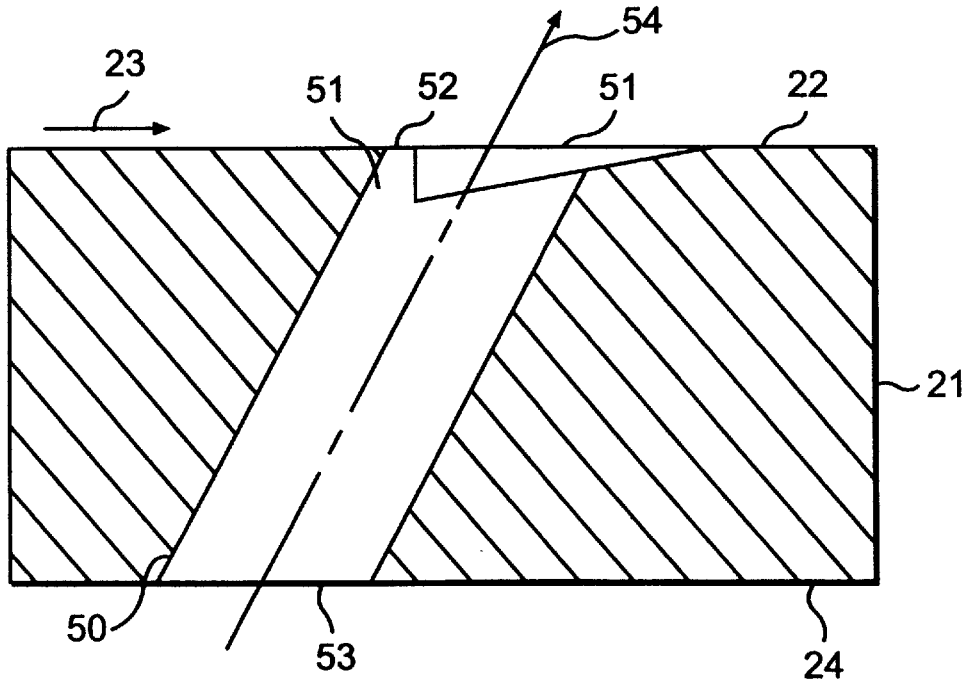
FIG. 36B is a sectional plan of line G—G of FIG. 36A.

FIG. 36A is a plan of an outlet of a coolant passage on the surface of the blade according to a twentieth embodiment of the present invention. FIG. 36B is a sectional plan of line G—G of FIG. 36A. In the twentieth embodiment, the center line 54 of the coolant passage 51 is inclined in the lateral direction of downstream side in relation to the gas flow 23. The diffusion outlet 55 is partially formed on the outlet 52. The shape of the diffusion outlet 55 is inclined vertically in the direction of the gas flow 23. In this structure, the cooling fluid flows from the outlet 52 along the center line 54 to the lateral direction of the downstream side. A part of the cooling fluid flows from the diffusion outlet 55 along the gas flow. The cooling fluid collides with the gas stream from a direction inclined to the gas flow 23. Therefore, gas stream roll-up of the cooling fluid flowing to the downstream side is avoided. Furthermore, the cooling fluid is spread widely on the downstream area and the temparature is uniformly distributed on the downstream area.

Figure 37A:
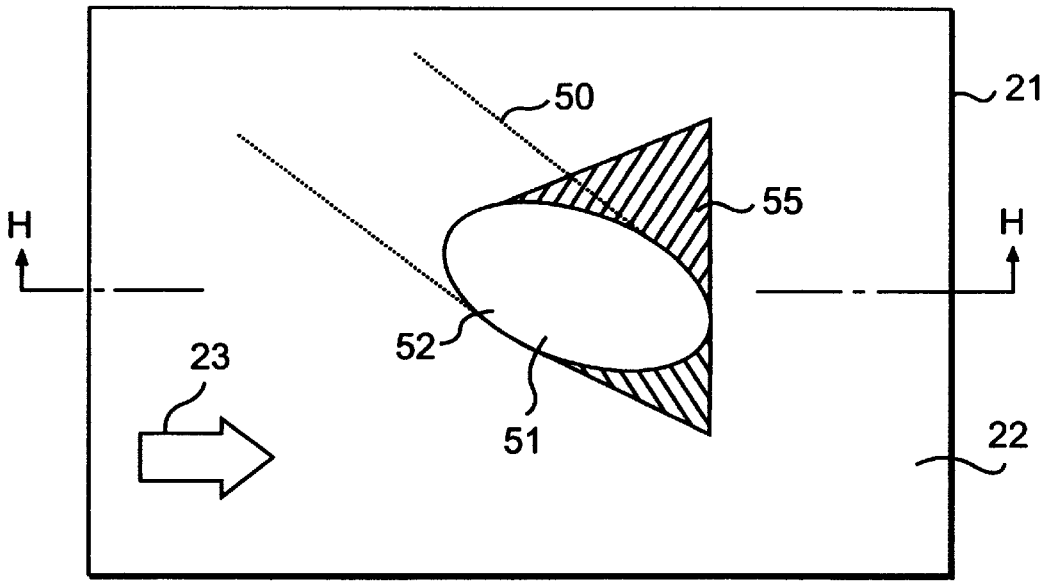
FIG. 37A is a schematic diagram of the outlet of the coolant passage on the surface of the blade according to a twenty-first embodiment of the present invention.
Figure 37B:
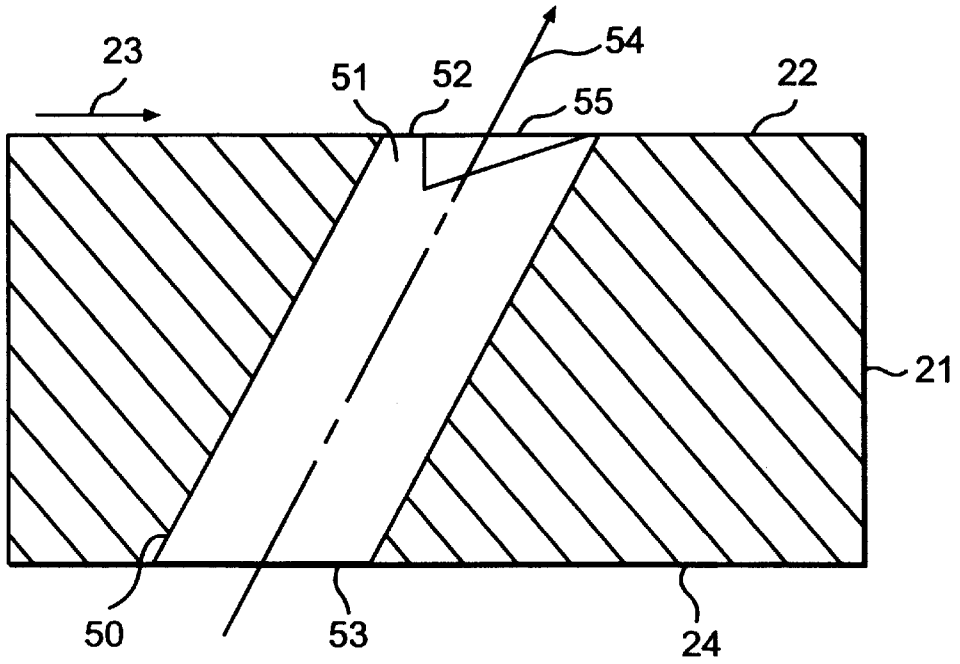
FIG. 37B is a sectional plan of line H—H of FIG. 37A.

FIG. 37A is a plan of an outlet of a coolant passage on the surface of the brade according to a twenty-first embodiment of the present invention. FIG. 37B is a sectional plan of line H—H of FIG. 37A. In the twenty-first embodiment, the center line 54 of the coolant passage 51 is inclined in the lateral direction of the downstream side of the gas flow 23. The diffusion outlet 55 is partially formed on the outlet 52. The shape of the diffusion outlet 55 is inclined laterally and vertically in the direction of the gas flow 23. In this structure, the cooling fluid flows from the outlet 52 along the center line 54 in the lateral direction of the downstream side. A part of the cooling fluid flows from the diffusion outlet 55 in the lateral direction. The cooling fluid collides with the gas stream from a direction inclined to the gas flow 23. Therefore, the gas stream roll-up of the cooling fluid flowing to the downstream side is avoided. Furthermore, the cooling fluid is spread widely on the downstream area and the temparature is uniformly distributed on the downstream area.

Figure 38A:
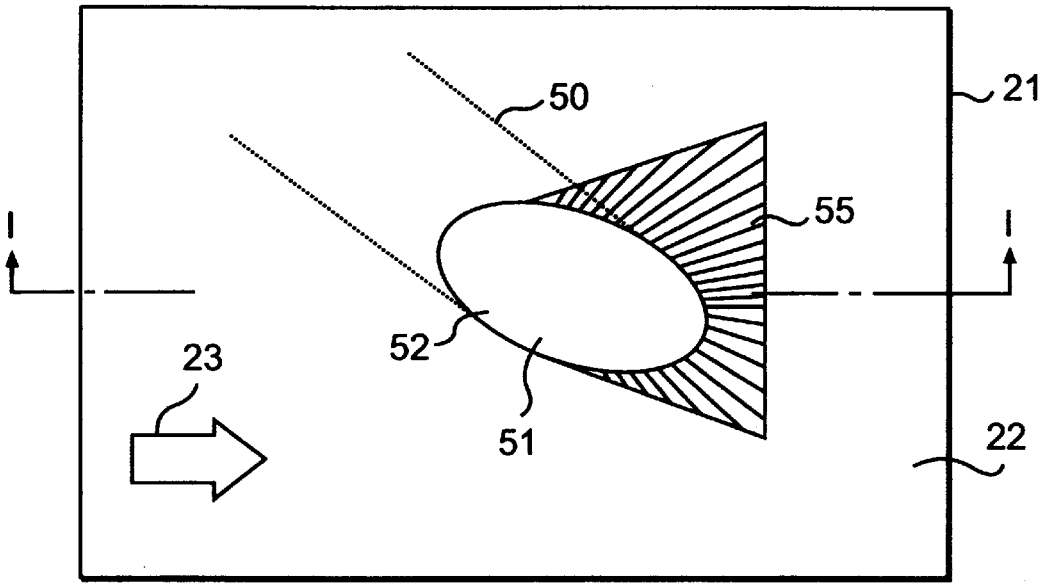
FIG. 38A is a schematic diagram of the outlet of the coolant passage on the surface of the blade according to a twenty-second embodiment of the present invention.
Figure 38B:
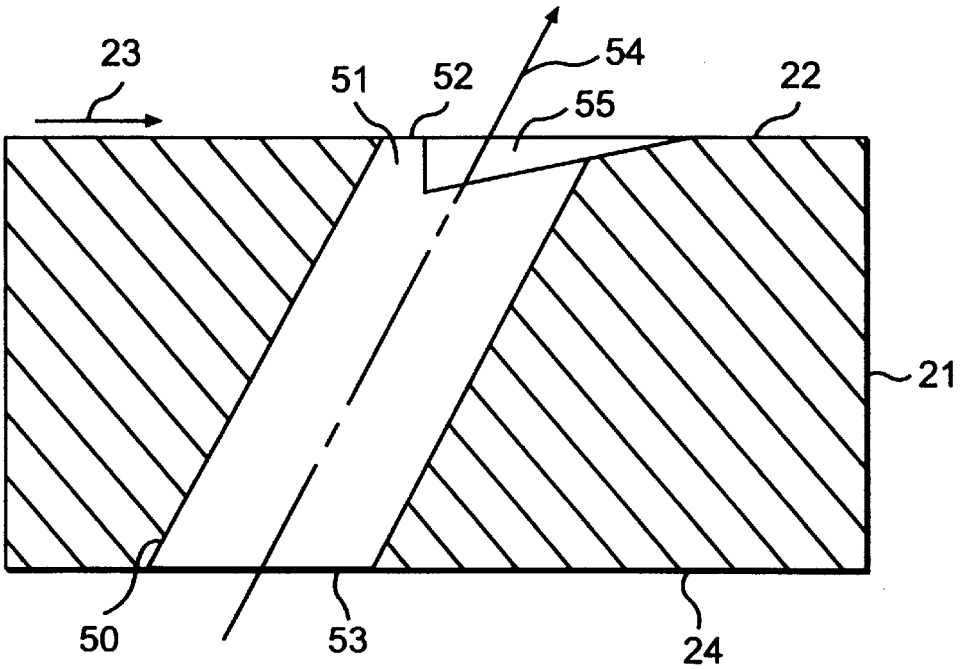
FIG. 38B is a sectional plan of line I—I of FIG. 38A.

FIG. 38A is a plan of an outlet of a coolant passage on the surface of the blade according to a twenty-second embodiment of the present invention. FIG. 38B is a sectional plan of line I—I of FIG. 38A. In the twenty-second embodiment, the center line 54 of the coolant passage 51 is inclined in the lateral direction of the downstream side of the gas flow 23. The diffusion outlet 55 is partially formed on the outlet 52. The shape of the diffusion outlet 55 is inclined laterally and vertically in the direction of the gas flow 23. In this structure, the cooling fluid flows from the outlet 52 along the center line 54 in the lateral direction of the downstream side. A part of the cooling fluid flows from the diffusion outlet 55 in the lateral direction. The cooling fluid collides with the gas stream from a direction inclined to the gas flow 23. Therefore, the gas stream roll-up of the cooling fluid flowing to the downstream side is avoided. Furthermore, the cooling fluid is spread widely on the downstream area and the temparature is distributed uniformly over the downstream area.

Figure 39A:
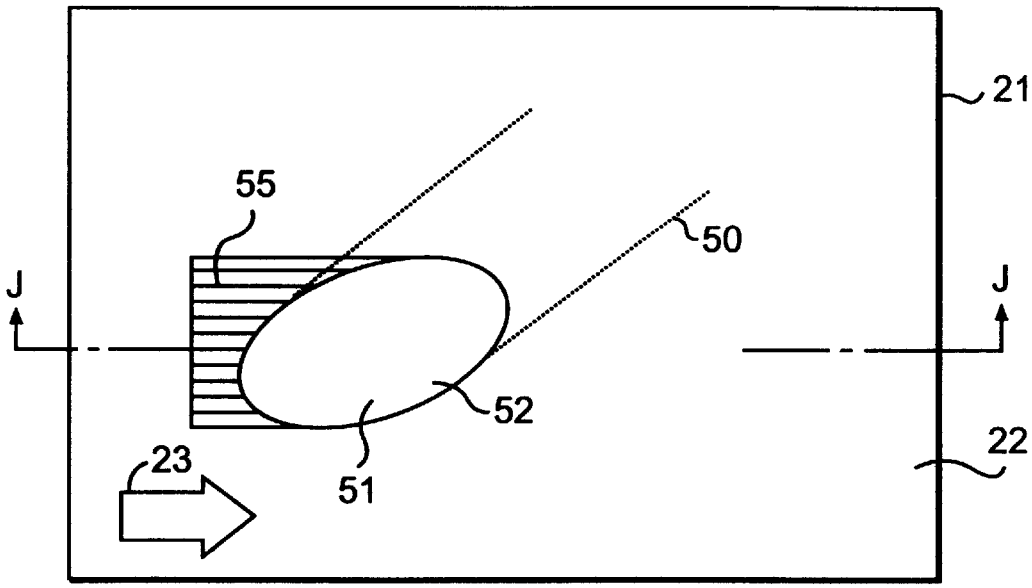
FIG. 39A is a schematic diagram of the outlet of the coolant passage on the surface of the blade according to a twenty-third embodiment of the present invention.
Figure 39B:
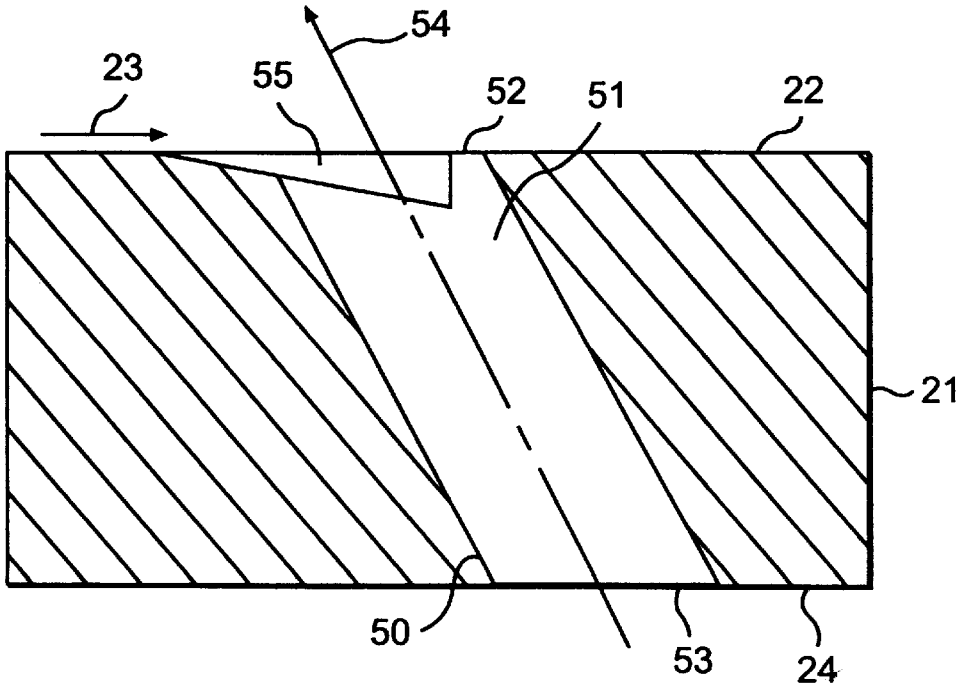
FIG. 39B is a sectional plan of line J—J of FIG. 39A.

FIG. 39A is a plan of an outlet of a coolant passage on the surface of the blade according to a twenty-third embodiment of the present invention. FIG. 39B is a sectional plan of line J—J of FIG. 39A. In the twenty-third embodiment, the center line 54 of the coolant passage 51 is inclined in the lateral direction of the upstream side of the gas flow 23. The diffusion outlet 55 is partially formed on the outlet 52. The shape of the diffusion outlet 55 is inclined vertically in the direction of the gas flow 23. In this structure, the cooling fluid flows from the outlet 52 along the center line 54 in the lateral direction of the upstream side. A part of the cooling fluid flows from the diffusion outlet 55 to the upstream side. The cooling fluid collides with the gas stream from a direction inclined to the gas flow 23. Therefore, the gas stream roll-up of the cooling fluid flowing to the downstream side is avoided. Furthermore, the cooling fluid is spread widely on the downstream area and the temparature is uniformly distributed on the downstream area.

Figure 40A:
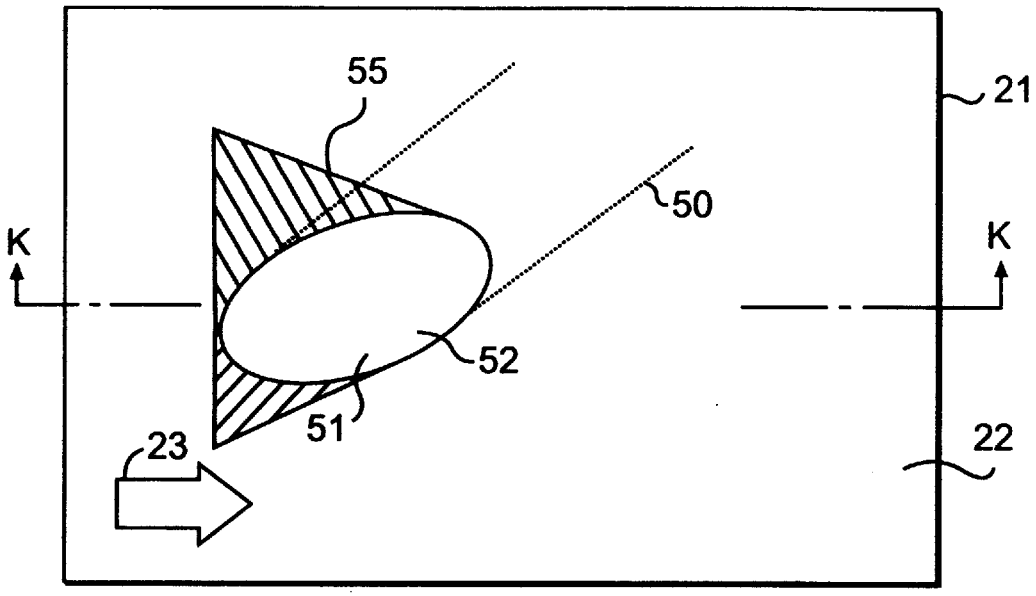
FIG. 40A is a schematic diagram of the outlet of the coolant passage on the surface of the blade according to a twenty-fourth embodiment of the present invention.
Figure 40B:
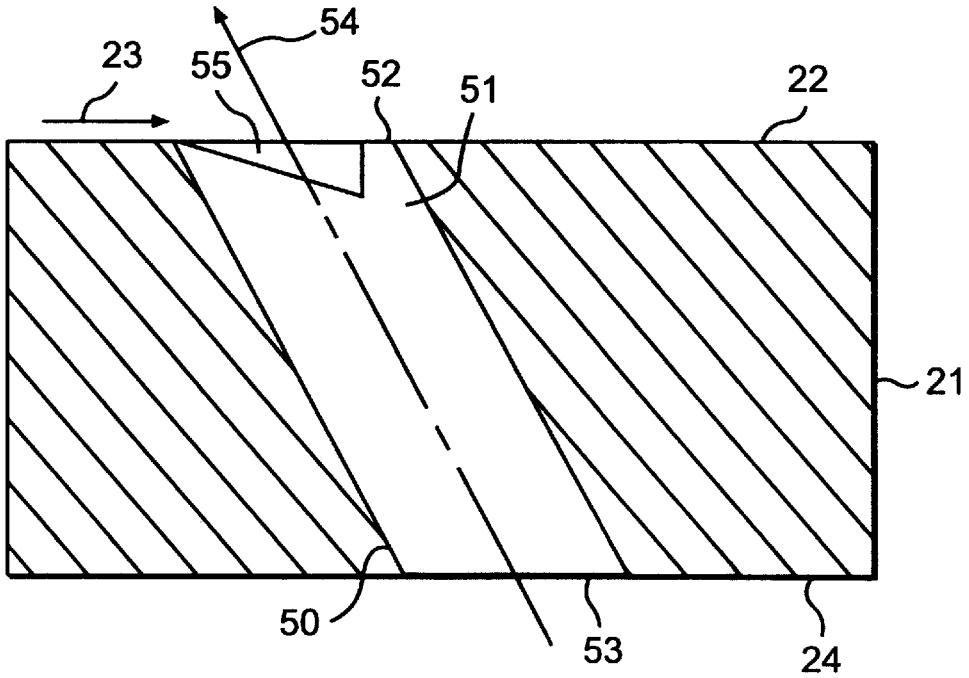
FIG. 40B is a sectional plan of line K—K of FIG. 40A.

FIG. 40A is a plan of an outlet of a coolant passage on the surface of the brade according to a twenty-fourth embodiment of the present invention. FIG. 40B is a sectional plan of line K—K of FIG. 40A. In the twenty-fourth embodiment, the center line 54 of the coolant passage 51 is inclined in the lateral direction of the upstream side of the gas flow 23. The diffusion outlet 55 is partially formed on the outlet 52. The shape of the diffusion outlet 55 is inclined vertically in the direction of the gas flow 23. In this structure, the cooling fluid flows from the outlet 52 along the center line 54 in the lateral direction of the upstream side. A part of the cooling fluid flows from the diffusion outlet 55 in the lateral direction. The cooling fluid collides with the gas stream from a direction inclined to the gas flow 23. Therefore, the gas stream roll-up of the cooling fluid flowing to the downstream side is avoided. Furthermore, the cooling fluid is spread widely on the downstream area and the temparature is uniformly distributed on the downstream area.

Figure 41A:
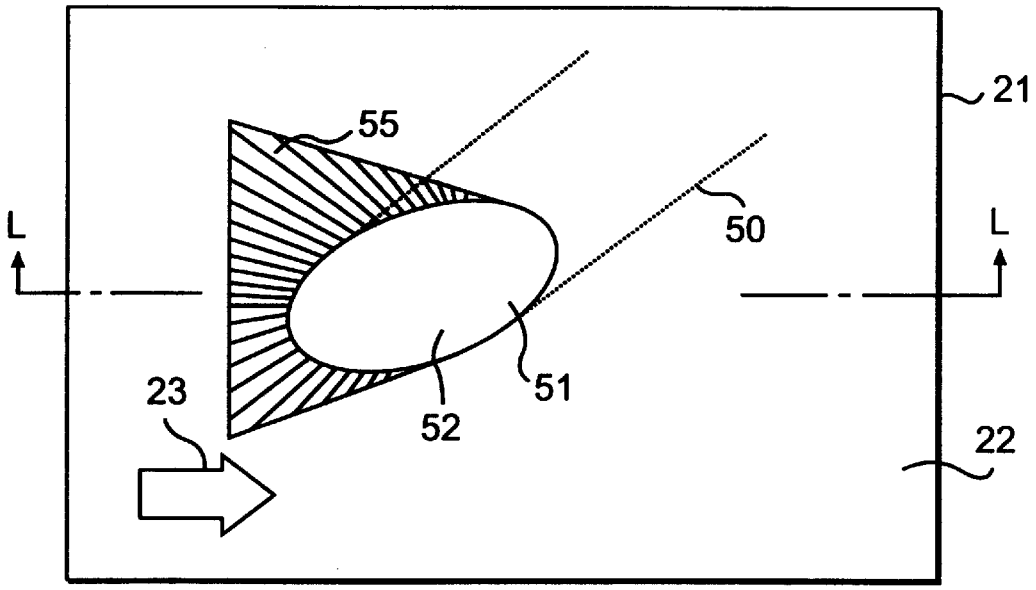
FIG. 41A is a schematic diagram of the outlet of the coolant passage on the surface of the blade according to a twenty-fifth embodiment of the present invention.
Figure 41B:
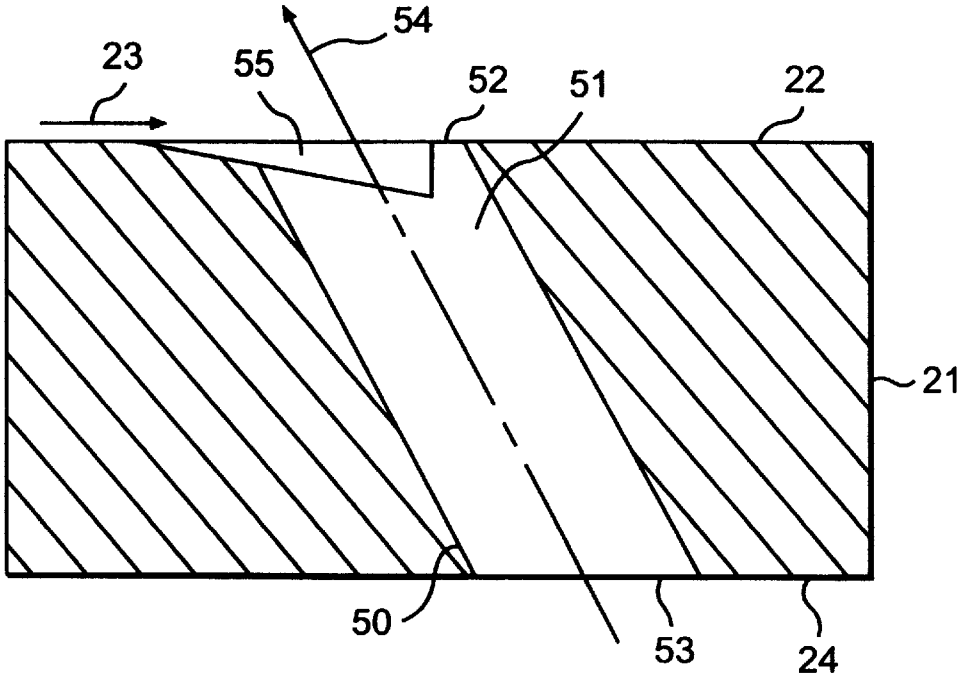
FIG. 41B is a sectional plan of line L—L of FIG. 41A.

FIG. 41A is a plan of an outlet of a coolant passage on the surface of the brade according to a twenty-fifth embodiment of the present invention. FIG. 41B is a sectional plan of line L—L of FIG. 41A. In the twenty-fifth embodiment, the center line 54 of the coolant passage 51 is inclined in the lateral direction of the upstream side of the gas flow 23. The diffusion outlet 55 is partially formed on the outlet 52. The shape of the diffusing outlet 55 is inclined laterally and vertically in the direction of the gas flow 23. In this structure, the cooling fluid flows from the outlet 52 along the center line 54 in the lateral direction of the upstream side. A part of the cooling fluid flows from the diffusion outlet 55 in the lateral direction. The cooling fluid collides with the gas stream from a direction inclined to the gas flow 23. Therefore, the gas stream roll-up of the cooling fluid flowing to the downstream side is avoided. Furthermore, the cooling fluid is spread widely on the downstream area and the temparature is uniformly distributed on the downstream area.

Figure 42:
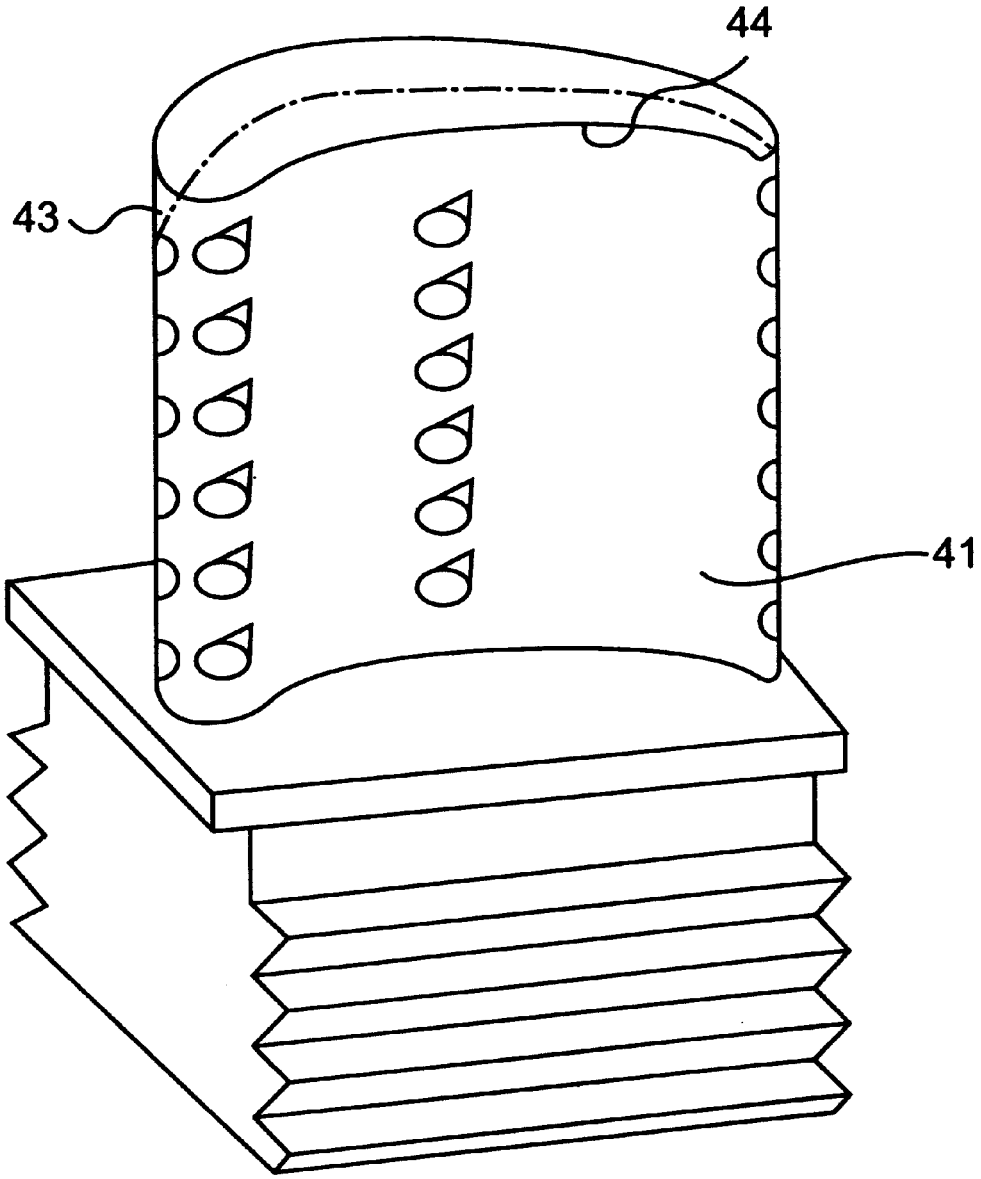
FIG. 42 is a schematic diagram of the turbine blade including the coolant passage according to the fourteenth embodiment.

FIG. 42 is a schematic diagram of the turbine blade including the coolant passage according to the fourteenth embodiment. In FIG. 42, the outlet 52 and the diffusion outlet 55 of FIG. 30A are applied to the leading edge 43 and the body wall 44 of the turbine brade 41.

What is claimed is:

1. An apparatus comprising a main body adapted for use in a gas stream, the main body having a plurality of fluid passages, each fluid passage having an outlet opening on a surface of the main body, wherein fluid can flow from each outlet to cover the surface as a film-like fluid, and wherein the plurality of fluid passages comprise:

a first fluid passage through which the fluid can flow from a first outlet to a downstream side of the gas stream on the surface; and a second fluid passage through which the fluid can flow from a second outlet to an upstream side of the gas stream on the surface;

the first outlet and the second outlet being separately located along a direction perpendicular to the direction of the gas stream on the surface so the fluid flowing from the second outlet collides with the gas stream and suppresses roll up of the fluid flowing from the first outlet.

2. The apparatus according to claim 1, wherein an area of the outlet of the second fluid passage is smaller than an area of the outlet of the first fluid passage.

3. The apparatus according to claim 1, wherein a center line of the first fluid passage is inclined toward the downstream side of the gas stream on the surface, and a center line of the second fluid passage is inclined toward the upstream side of the gas stream.

4. The apparatus according to claim 1, wherein the main body is a turbine blade or a turbine nozzle of a gas turbine.

5. The apparatus according to claim 1, wherein there are a plurality of first fluid passages and a plurality of second fluid passages, each first outlet of the first fluid passages is positioned between a pair of the second outlets of the second fluid passages, and each second fluid passage in each pair is configured to direct the fluid to flow toward the fluid flowing from the other second fluid passage in each pair.

6. The apparatus according to claim 1, wherein there are a plurality of first fluid passages and a plurality of second fluid passages, and the second outlet openings for the second fluid passages are mutually arranged downstream of the first outlet openings for the first fluid passages.

7. An apparatus comprising a main body adapted for use in a gas stream, the main body having a plurality of fluid passages, each fluid passage having an outlet opening on a surface of the main body, wherein fluid can flow from each outlet through the passage to cover the surface as a film-like fluid, and wherein the plurality of fluid passages comprise:

a first fluid passage through which the fluid can flow from a first outlet to a downstream side of the gas stream along a predetermined direction different from the direction of the gas stream on the surface; and a second fluid passage through which the fluid can flow from a second outlet to an upstream side of the gas stream on the surface;

the first outlet and the second outlet being separately and mutually located along a direction perpendicular to the direction of the gas stream on the surface so the fluid flowing from the second outlet collides with the gas stream and suppresses roll up of the fluid flowing from the first outlet.

8. The apparatus according to claim 7, wherein a centerline of the second fluid passage is inclined toward the upstream side of the gas stream.

9. The apparatus according to claim 7, wherein a projection of a center line of the second fluid passage onto a plane including the first outlet and the second outlet on the surface is parallel to a projection of a center line of the first fluid passage onto the plane.

10. The apparatus according to claim 7, wherein a center line of the second fluid passage is different from both the direction of the gas stream and the direction of the center line of the first fluid passage.

11. The apparatus according to claim 7, wherein the main body is a turbine blade or a turbine nozzle of a gas turbine.

12. An apparatus comprising a main body adapted for use in a gas stream, the main body having a plurality of fluid passages, each fluid passage having an outlet opening on a surface of the main body, wherein fluid can flow from each outlet through each fluid passage to cover the surface as a film-like fluid, wherein a center line of each fluid passage is inclined toward an upstream side of the gas stream on the surface;

each outlet is separately located along a direction perpendicular to the direction of the gas stream on the surface so the fluid flowing from the outlet collides with the gas stream and suppresses roll up of the fluid flowing from the outlet on the surface; and an angle between the center line of each fluid passage and the direction of the gas stream is an obtuse angle.

13. The apparatus according to claim 12, wherein each fluid passage includes a downstream inner wall inclined from a predetermined inner position to a position on the downstream side of the surface.

14. The apparatus according to claim 12, wherein each fluid passage includes a upstream inner wall inclined from a predetermined inner position to a position on the upstream side of the surface.

15. The apparatus according to claim 12, wherein the fluid passage includes an inner wall, the downstream inner wall being inclined from a predetermined inner position to a position on the downstream side of the the surface, and the upstream inner wall being inclined from a predetermined inner position to a position on the upstream side of the surface.

16. The apparatus according to claim 12, wherein the main body is a turbine blade or a turbine nozzle of a gas turbine.

* * * * *

UNITED STATES PATENT AND TRADEMARK OFFICE

CERTIFICATE OF CORRECTION

PATENT NO. : 6,092,982
DATED : July 25, 2000
INVENTOR(S) : Kazutaka Ikeda et al.

It is certified that error appears in the above-identified patent and that said Letters Patent is hereby corrected as shown below:

Claim 14, column 16,
Line 12, "a upstream" should read -- an upstream --.

Claim 15, column 16,
Line 17, after "includes", delete "an inner wall, the".
Line 18, before "downstream", insert -- a --.
Line 20, after "side of the", delete "the" (second occurrence); and "the upstream" should read -- the fluid passage includes an upstream --.

Signed and Sealed this

Second Day of October, 2001

*Attest:*

Nicholas P. Godici

*Attesting Officer*

NICHOLAS P. GODICI
*Acting Director of the United States Patent and Trademark Office*